US008790151B2

(12) United States Patent
Bertrand et al.

(10) Patent No.: US 8,790,151 B2
(45) Date of Patent: Jul. 29, 2014

(54) TOY CONSTRUCTION BASE PLATE

(75) Inventors: Vic Bertrand, Beaconsfield (CA); Alexandre Huneau, Mascouche (CA); Réal Laurent Lanoix, Laval (CA); Yanick Tremblay, Laval (CA)

(73) Assignee: MEGA Brands Inc., Montreal, Quebec (CA)

( * ) Notice: Subject to any disclaimer, the term of this patent is extended or adjusted under 35 U.S.C. 154(b) by 510 days.

(21) Appl. No.: 13/159,450

(22) Filed: Jun. 14, 2011

(65) Prior Publication Data

US 2012/0149275 A1 Jun. 14, 2012

Related U.S. Application Data

(60) Provisional application No. 61/358,625, filed on Jun. 25, 2010.

(51) Int. Cl.
*A63H 33/04* (2006.01)

(52) U.S. Cl.
USPC ..... 446/85; 446/487; 446/128; 446/93

(58) Field of Classification Search
USPC ..... 446/487, 376, 93–95, 85, 128, 230, 231
See application file for complete search history.

(56) References Cited

U.S. PATENT DOCUMENTS

| | | | | |
|---|---|---|---|---|
| 1,800,775 | A | 4/1931 | Bostwick | |
| 2,416,805 | A | 3/1947 | Walker | |
| 3,540,151 | A * | 11/1970 | Ishida | 446/90 |
| 3,623,756 | A * | 11/1971 | Fischer | 403/62 |
| 4,043,075 | A * | 8/1977 | Breneman | 446/230 |
| 4,185,410 | A | 1/1980 | Kristiansen | |
| 4,206,564 | A * | 6/1980 | Ogawa | 446/94 |
| 4,214,402 | A * | 7/1980 | Ogawa | 446/90 |
| 4,248,006 | A * | 2/1981 | Jones et al. | 446/89 |
| 4,307,533 | A * | 12/1981 | Sims et al. | 446/94 |
| 4,467,556 | A * | 8/1984 | Iwao et al. | 446/230 |
| 4,515,571 | A * | 5/1985 | Kozuka et al. | 446/90 |

(Continued)

FOREIGN PATENT DOCUMENTS

CA 1207530 7/1986

OTHER PUBLICATIONS

International Search Report and Written Opinion mailed Nov. 15, 2011 in International Application No. PCT/IB2011/001402.

(Continued)

*Primary Examiner* — Gene Kim
*Assistant Examiner* — Urszula M Cegielnik
(74) *Attorney, Agent, or Firm* — Plumsea Law Group, LLC

(57) ABSTRACT

A toy construction base plate configured to receive a toy construction and having a collapsible handle, which allows the construction to be built on the base plate on a flat play surface, after which the handle may be deployed from the base plate to allow a user to hold and play with the toy construction. The handle may be deployed by, for example, pivoting with respect to a support member of the base plate and pivoting above, below, or to the side of the toy construction. The handle may also be used as a stand to hold a construction above a play surface. The toy construction may be made of interlocking stackable blocks and the support surface of the base plate may be configured to receive the interlocking stackable blocks.

28 Claims, 24 Drawing Sheets

(56) References Cited

U.S. PATENT DOCUMENTS

| | | | | | |
|---|---|---|---|---|---|
| 4,516,948 | A | * | 5/1985 | Obara | 446/95 |
| 4,561,184 | A | * | 12/1985 | Fujitani | 33/27.02 |
| 4,571,206 | A | | 2/1986 | Mayer et al. | |
| 4,599,078 | A | * | 7/1986 | Obara | 446/95 |
| 4,668,205 | A | * | 5/1987 | Choy et al. | 446/230 |
| 4,674,990 | A | * | 6/1987 | Ohno | 446/376 |
| 4,680,018 | A | * | 7/1987 | Ohno | 446/376 |
| 4,708,683 | A | * | 11/1987 | Lehmann et al. | 446/75 |
| 4,717,365 | A | * | 1/1988 | Andersen et al. | 446/230 |
| 4,750,895 | A | * | 6/1988 | Shinohara et al. | 446/230 |
| 4,762,513 | A | * | 8/1988 | Choy et al. | 446/359 |
| 4,826,464 | A | | 5/1989 | Bertrand | |
| 4,850,922 | A | * | 7/1989 | Harris | 446/7 |
| 4,919,639 | A | * | 4/1990 | Hesse | 446/462 |
| 4,946,413 | A | * | 8/1990 | Lehmann et al. | 446/28 |
| 4,988,320 | A | * | 1/1991 | Rankin et al. | 446/62 |
| 5,019,007 | A | * | 5/1991 | Miller | 446/62 |
| 5,052,680 | A | * | 10/1991 | Malewicki et al. | 472/137 |
| 5,094,646 | A | * | 3/1992 | Marceau | 446/491 |
| 5,427,558 | A | * | 6/1995 | Knudsen et al. | 446/102 |
| 5,779,515 | A | * | 7/1998 | Chung | 446/90 |
| 5,782,185 | A | | 7/1998 | Frahm et al. | |
| 5,785,572 | A | | 7/1998 | Levy et al. | |
| 5,810,638 | A | * | 9/1998 | Wood | 446/73 |
| 5,827,106 | A | * | 10/1998 | Crepeau et al. | 446/128 |
| 5,913,706 | A | * | 6/1999 | Glickman et al. | 446/97 |
| 6,152,799 | A | | 11/2000 | Arriola | |
| 6,346,025 | B1 | * | 2/2002 | Tachau et al. | 446/71 |
| 6,659,839 | B2 | * | 12/2003 | Iwasawa | 446/230 |
| 7,594,844 | B2 | | 9/2009 | Cartlidge et al. | |
| 7,662,016 | B2 | * | 2/2010 | Okamoto et al. | 446/376 |
| 7,673,624 | B2 | * | 3/2010 | Rosella, Jr. | 124/10 |
| 7,722,426 | B2 | * | 5/2010 | Campbell | 446/4 |
| 7,753,753 | B2 | * | 7/2010 | Payne et al. | 446/75 |
| 7,942,721 | B2 | * | 5/2011 | Wade | 446/473 |
| 7,955,156 | B2 | * | 6/2011 | Toht et al. | 446/92 |
| 8,187,049 | B2 | * | 5/2012 | Corsiglia et al. | 446/37 |

OTHER PUBLICATIONS

Lego Hinge Plate 2×9 Part No. 3324c01, http://www.peeron.com/inv/parts/3324c01, retrieved Feb. 26, 2010.

Fisher Price Rescue Heroes Jet Plane, http://cgi.ebay.com/FISHER-PRICE-VOICE-TECH-RESCUE-HEROES-JET-PLANE-FIGURES-/380352806994, retrieved Jul. 25, 2011.

Photograph of Fisher Price Rescue Heroes Jet Plane, date unknown.

* cited by examiner

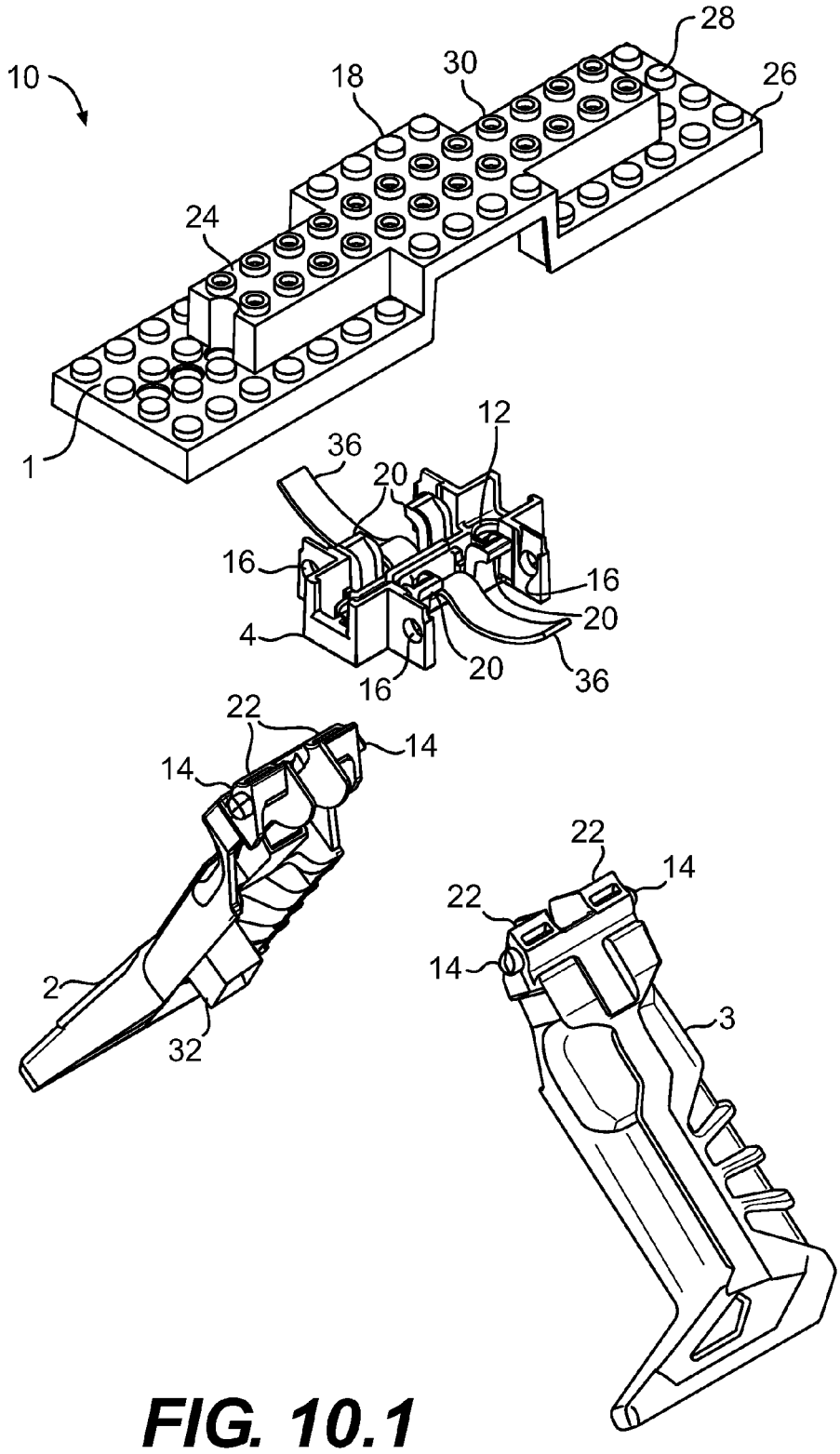
FIG. 10.1

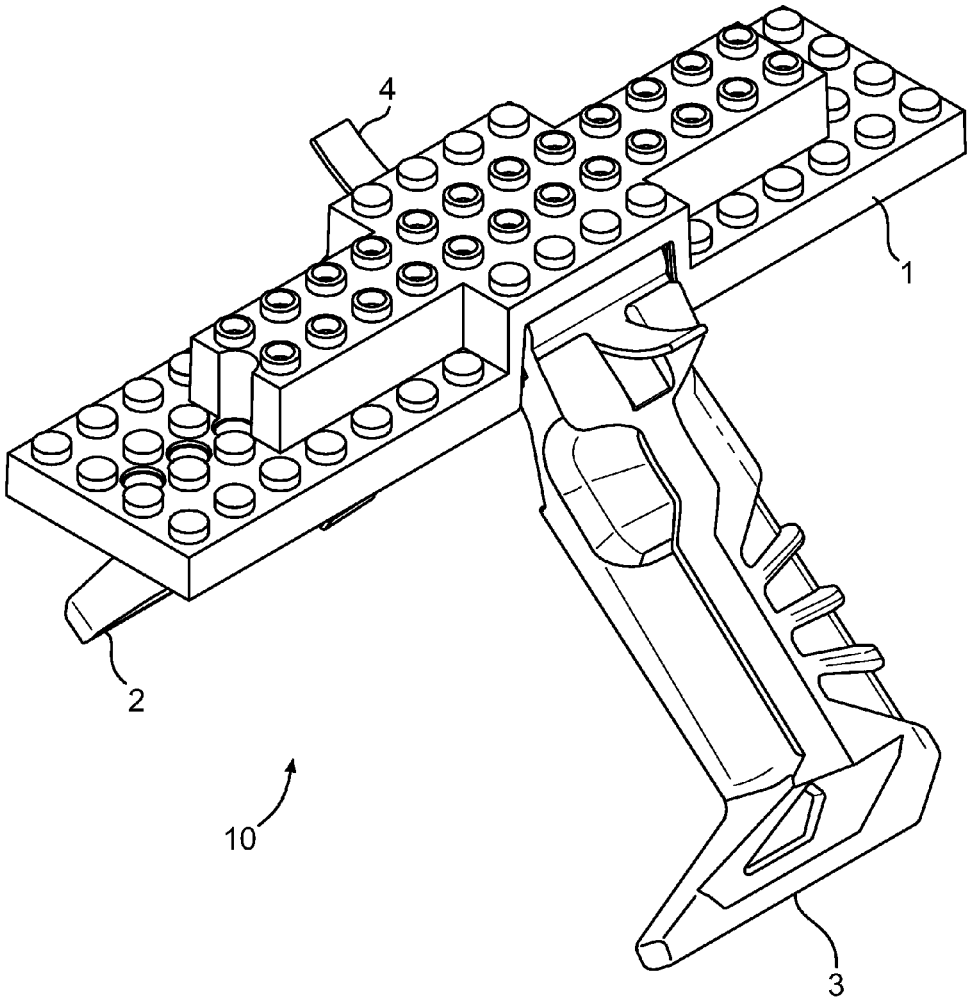
FIG. 10.2

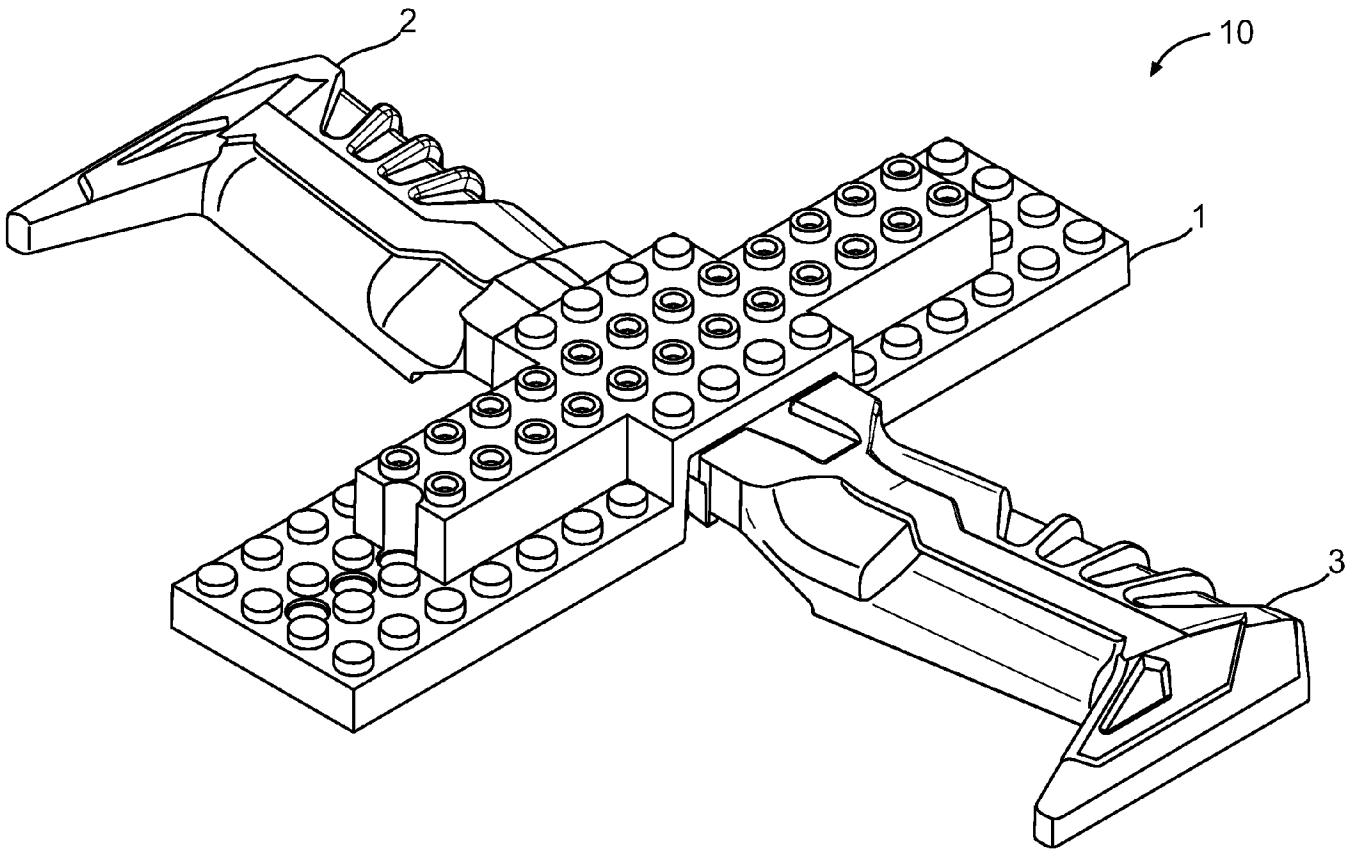
FIG. 11.1

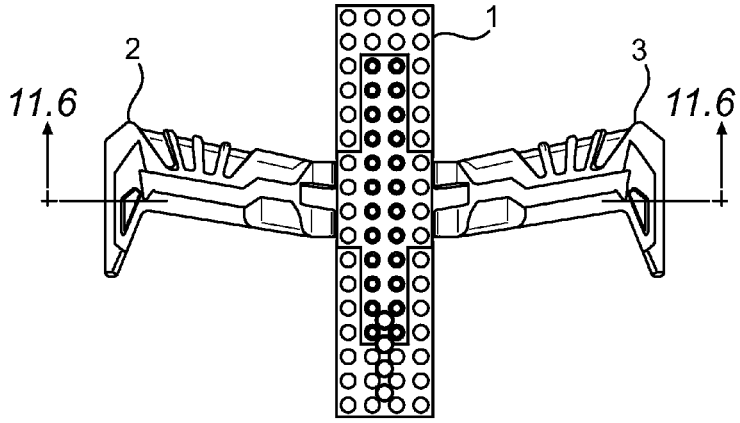
FIG. 11.4
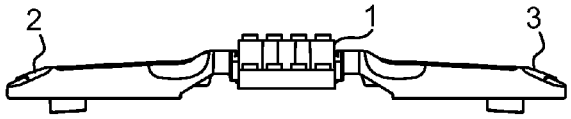
FIG. 11.2
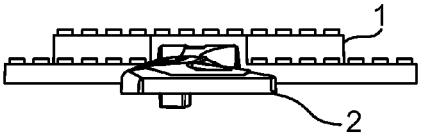
FIG. 11.3
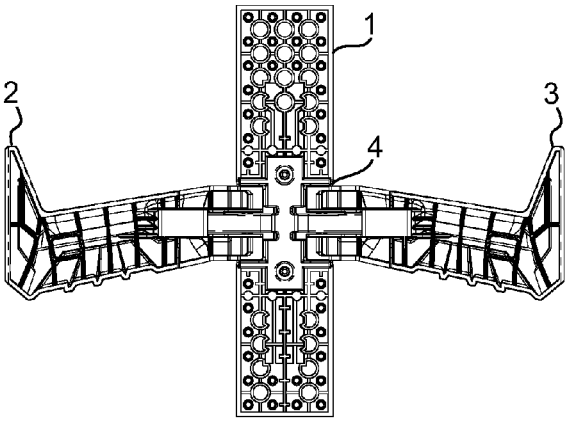
FIG. 11.5

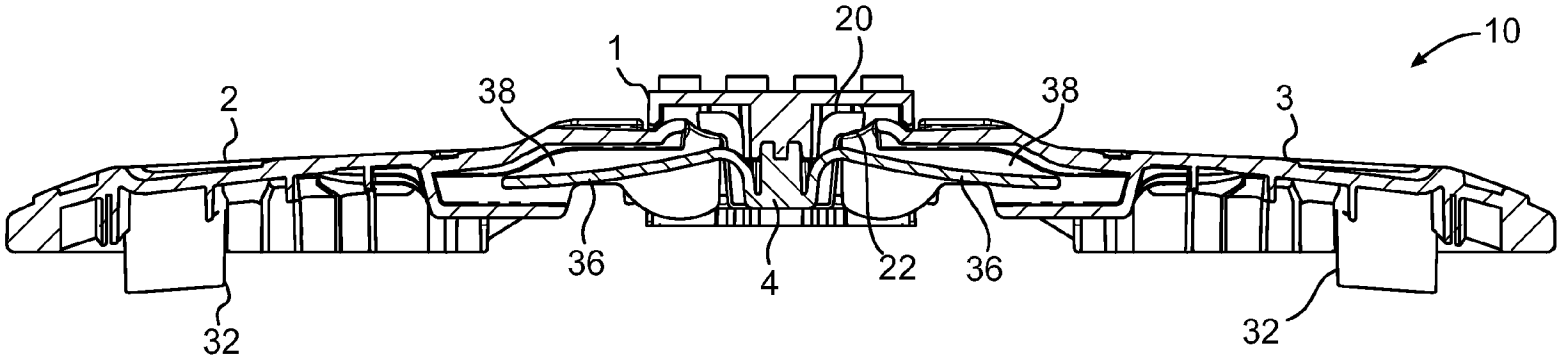
FIG. 11.6

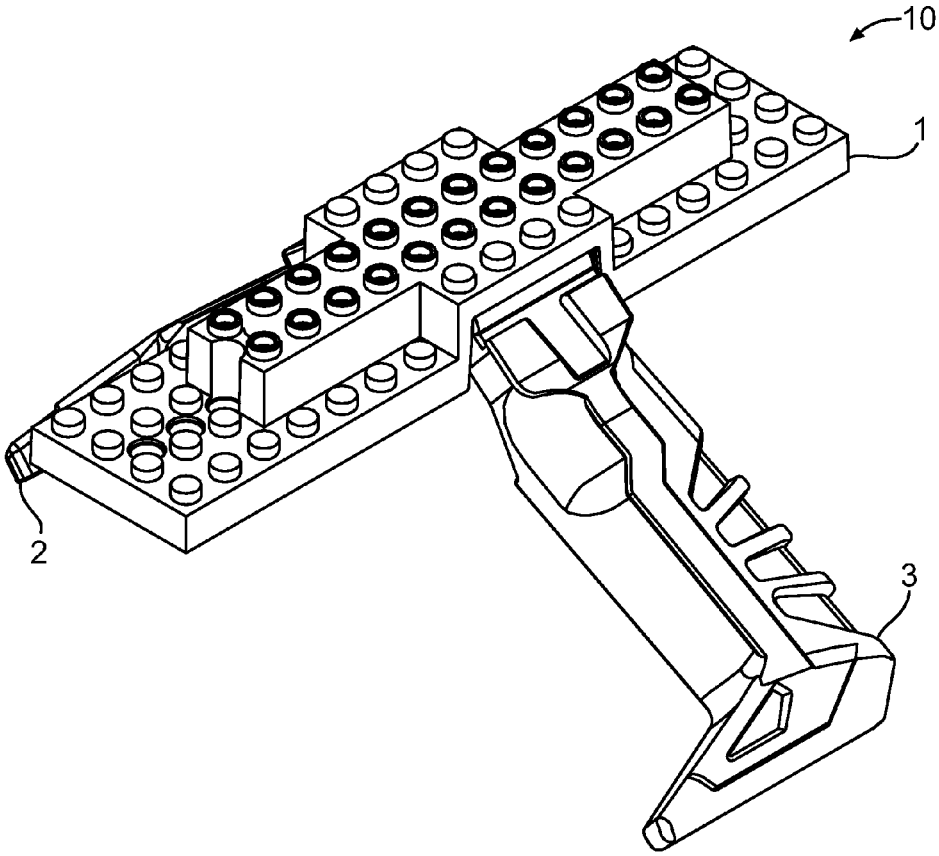
FIG. 12.1

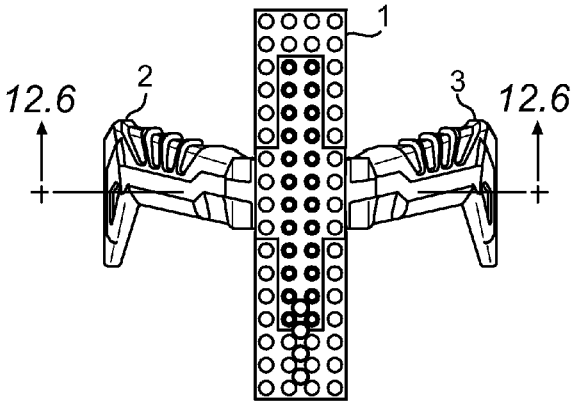
FIG. 12.4
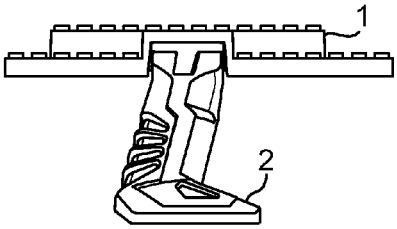
FIG. 12.3
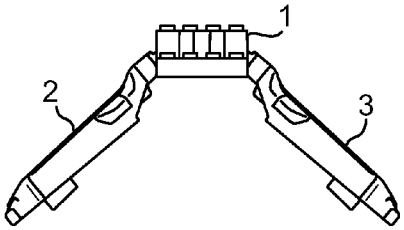
FIG. 12.2
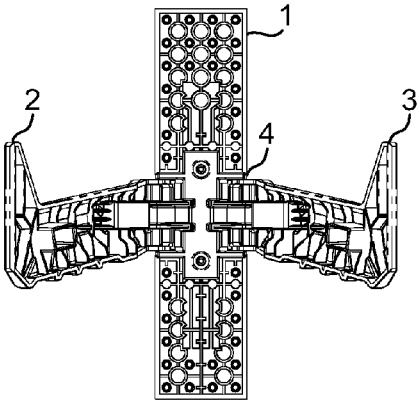
FIG. 12.5

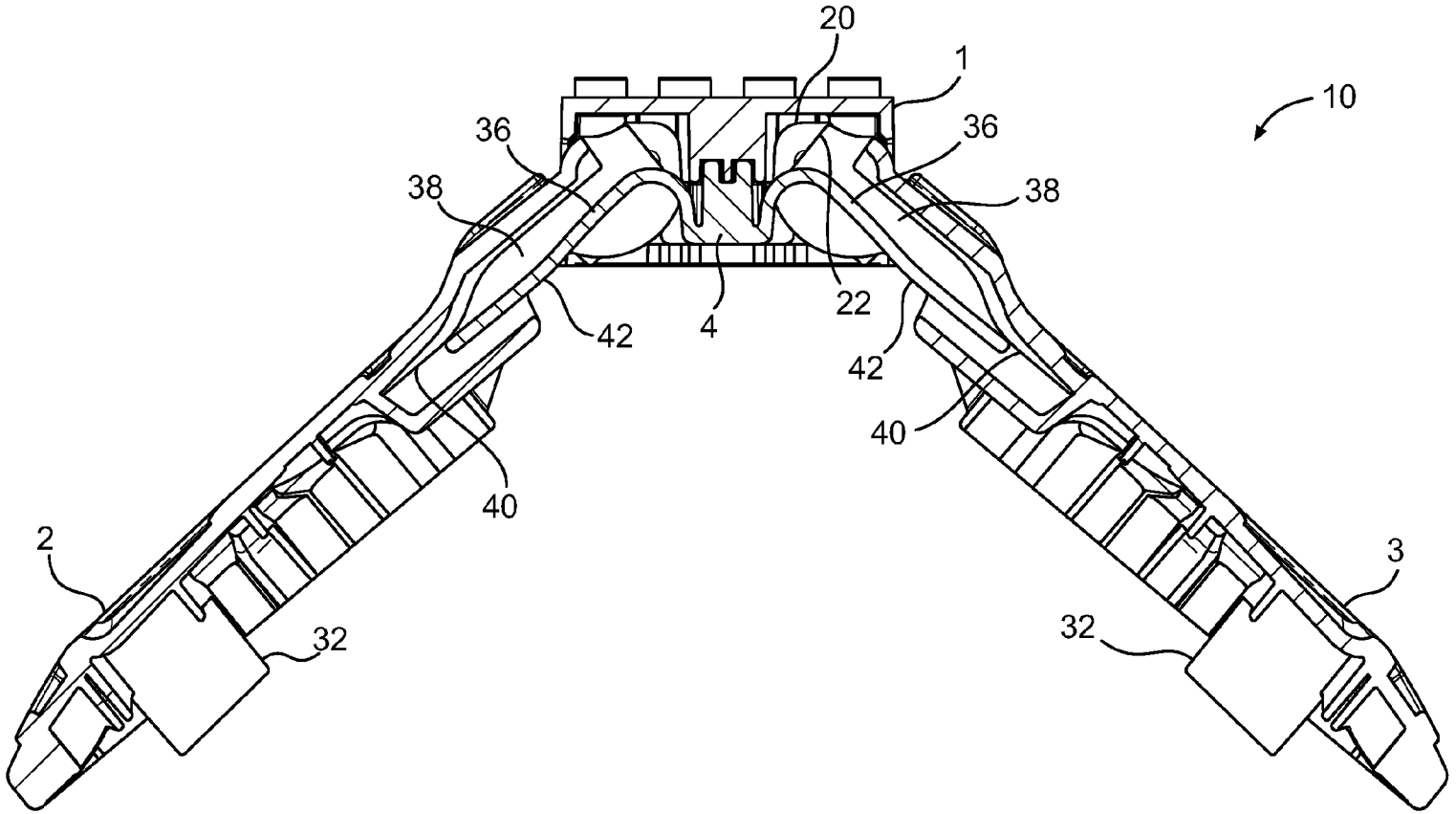
FIG. 12.6

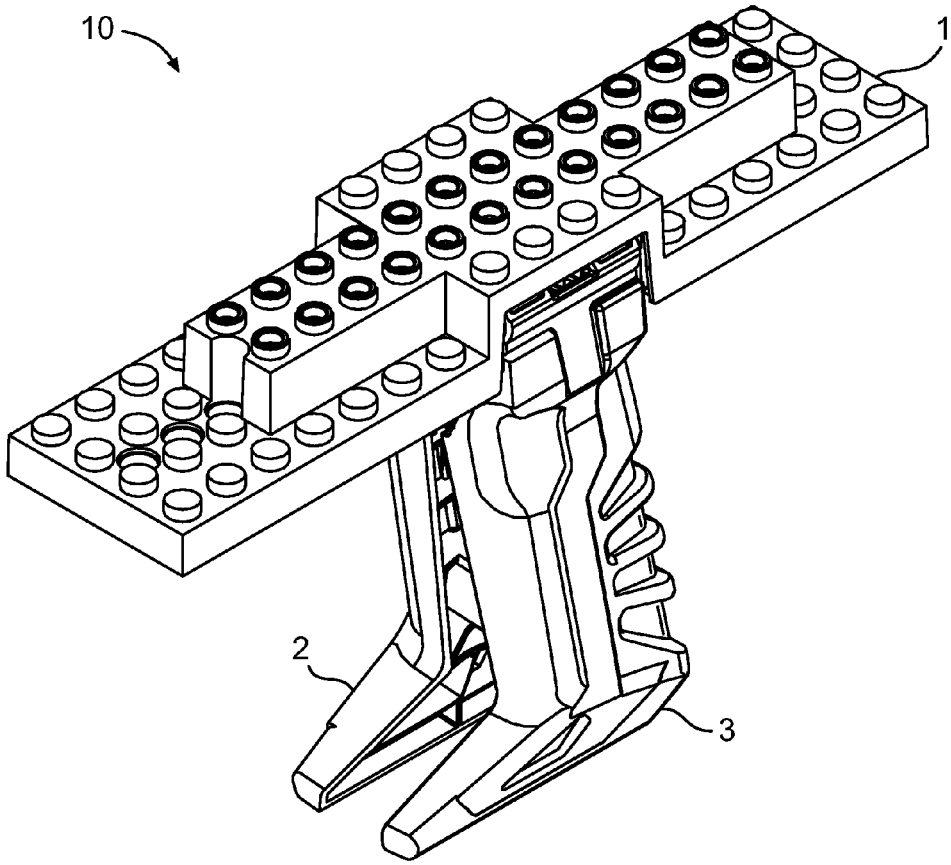
FIG. 13.1

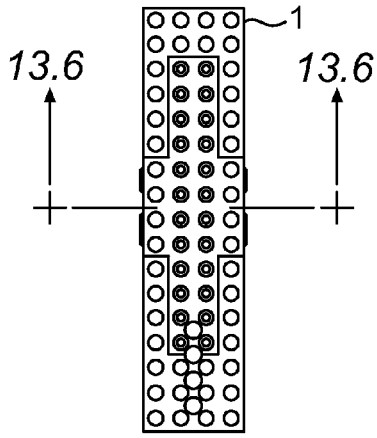
FIG. 13.4
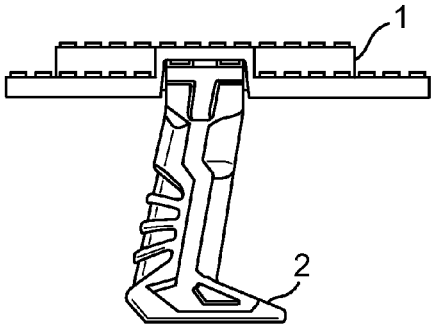
FIG. 13.3
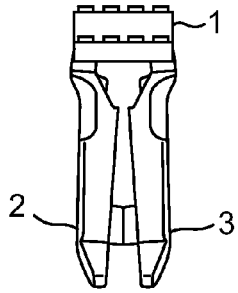
FIG. 13.2
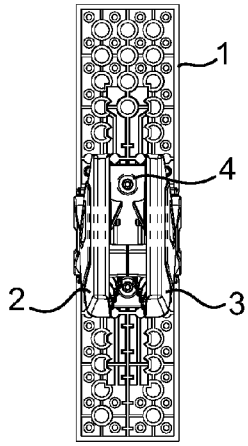
FIG. 13.5

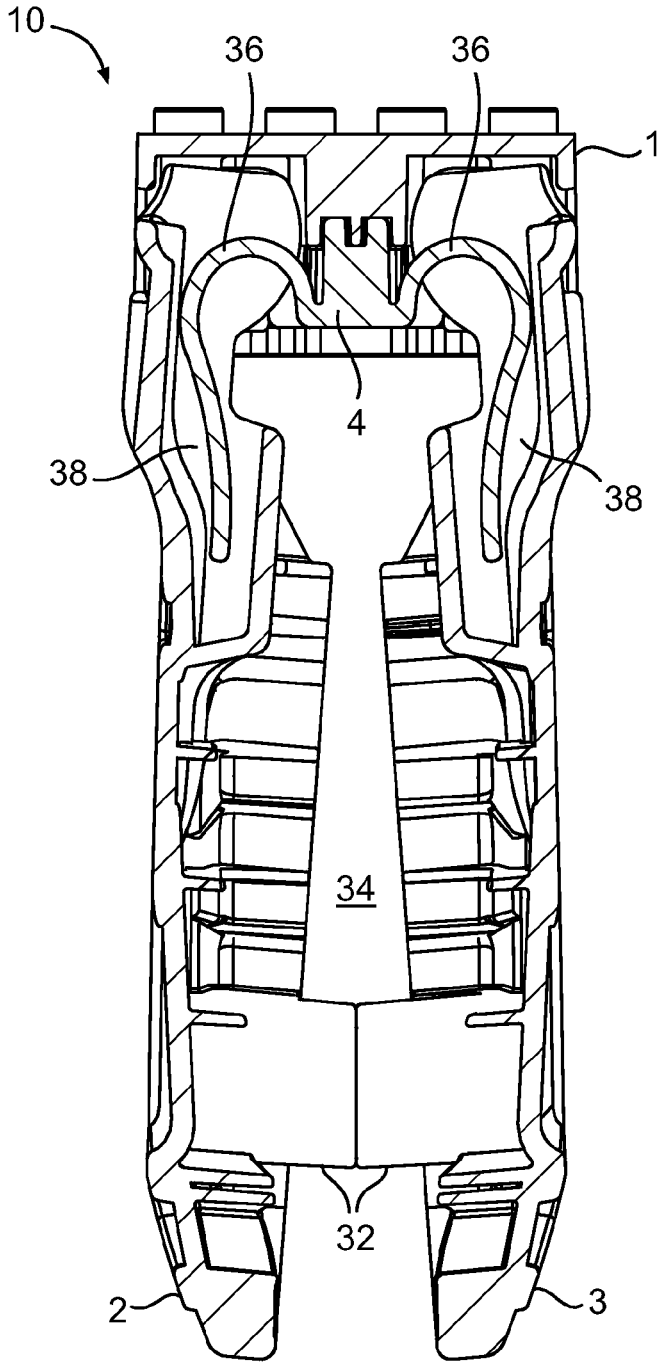
FIG. 13.6

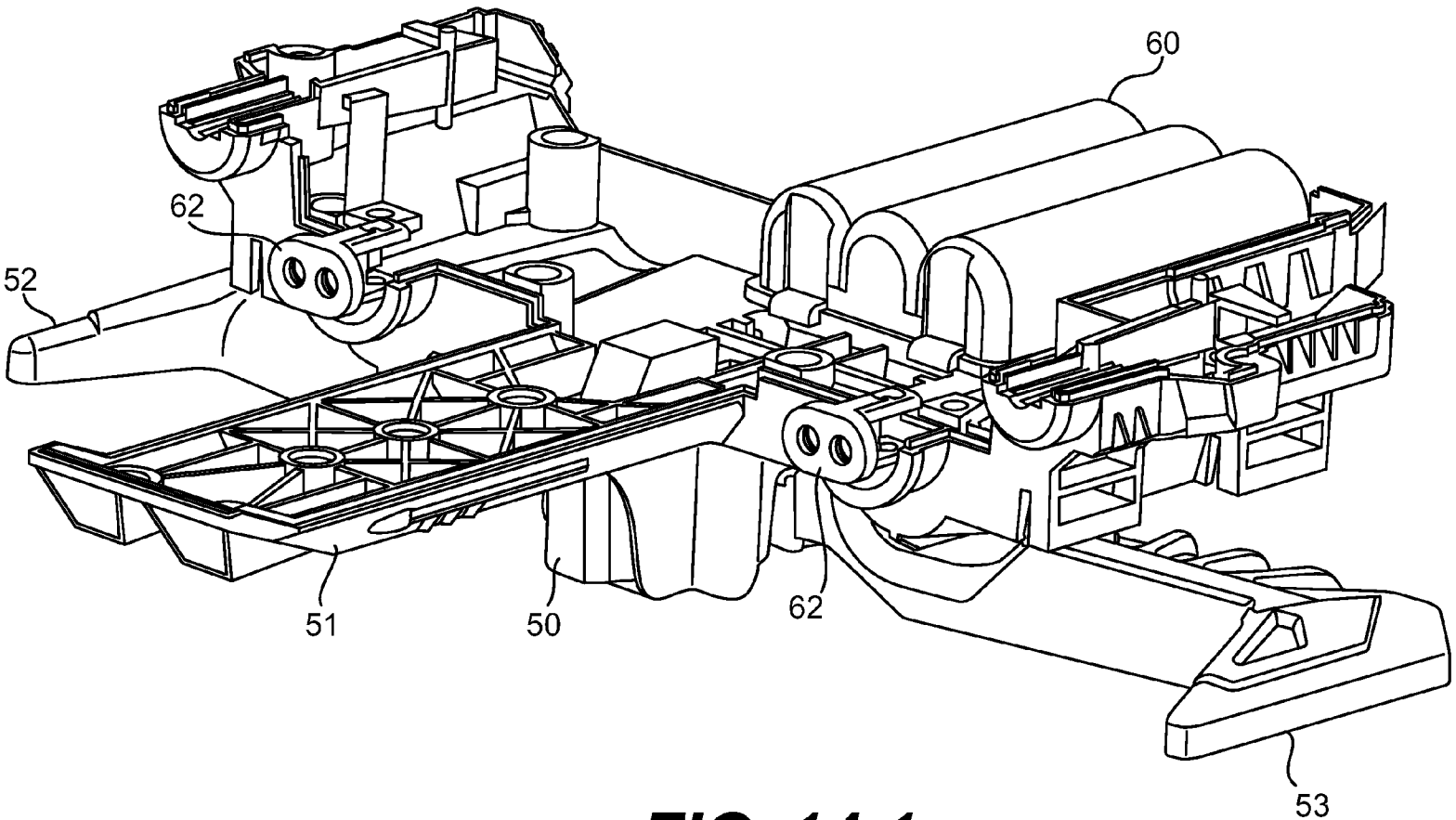
FIG. 14.1

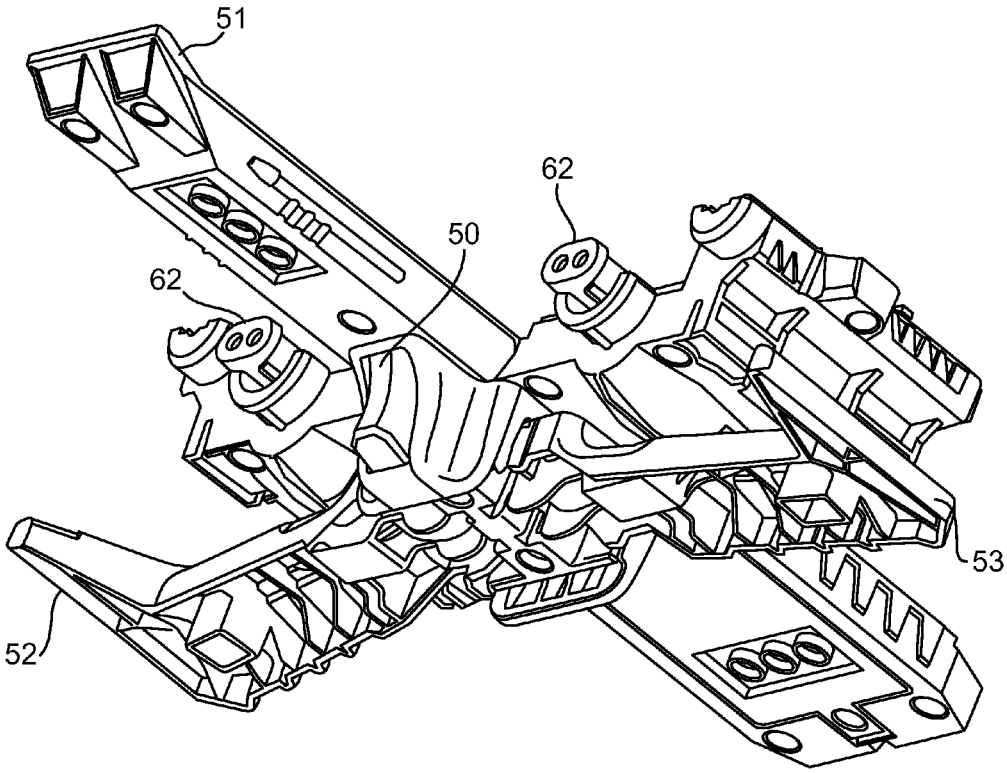
FIG. 14.2

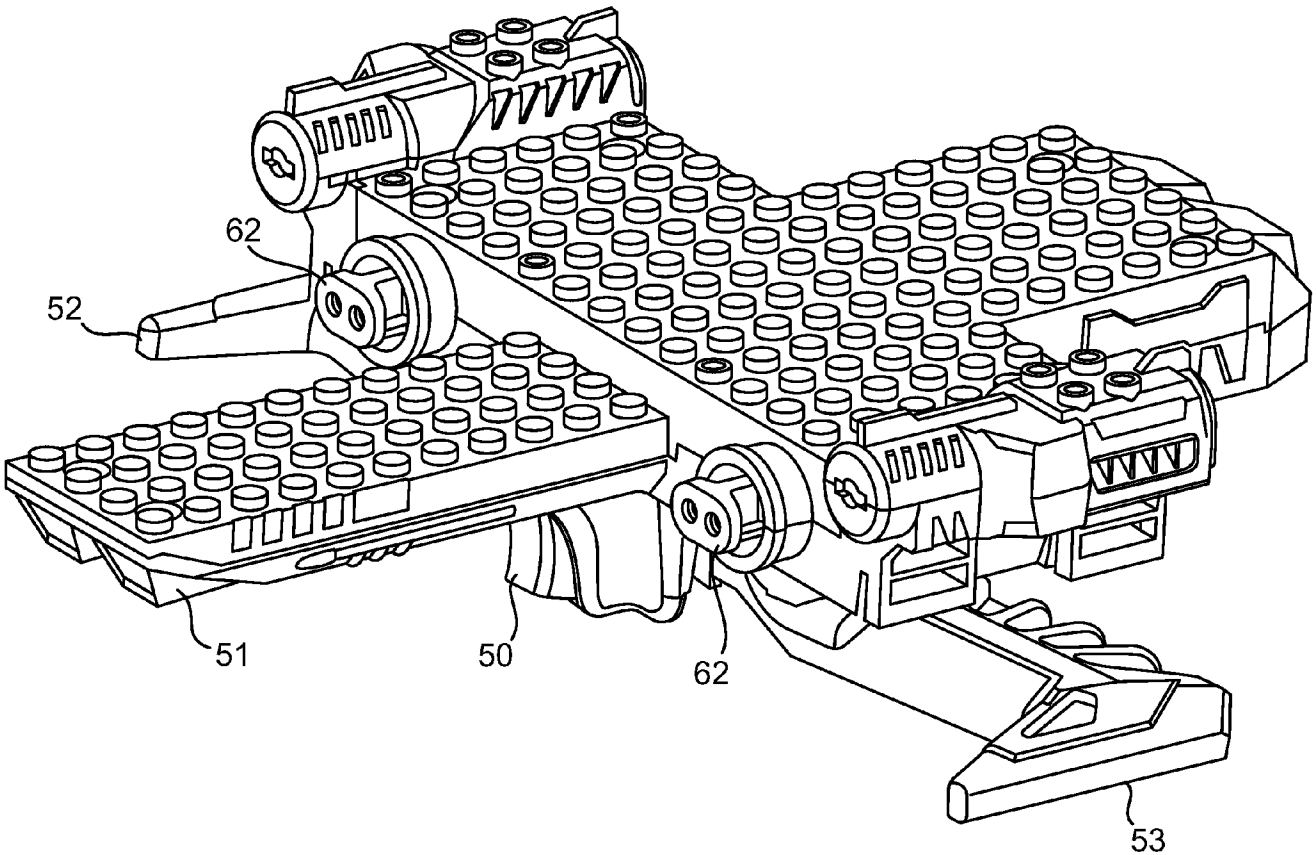
FIG. 14.3

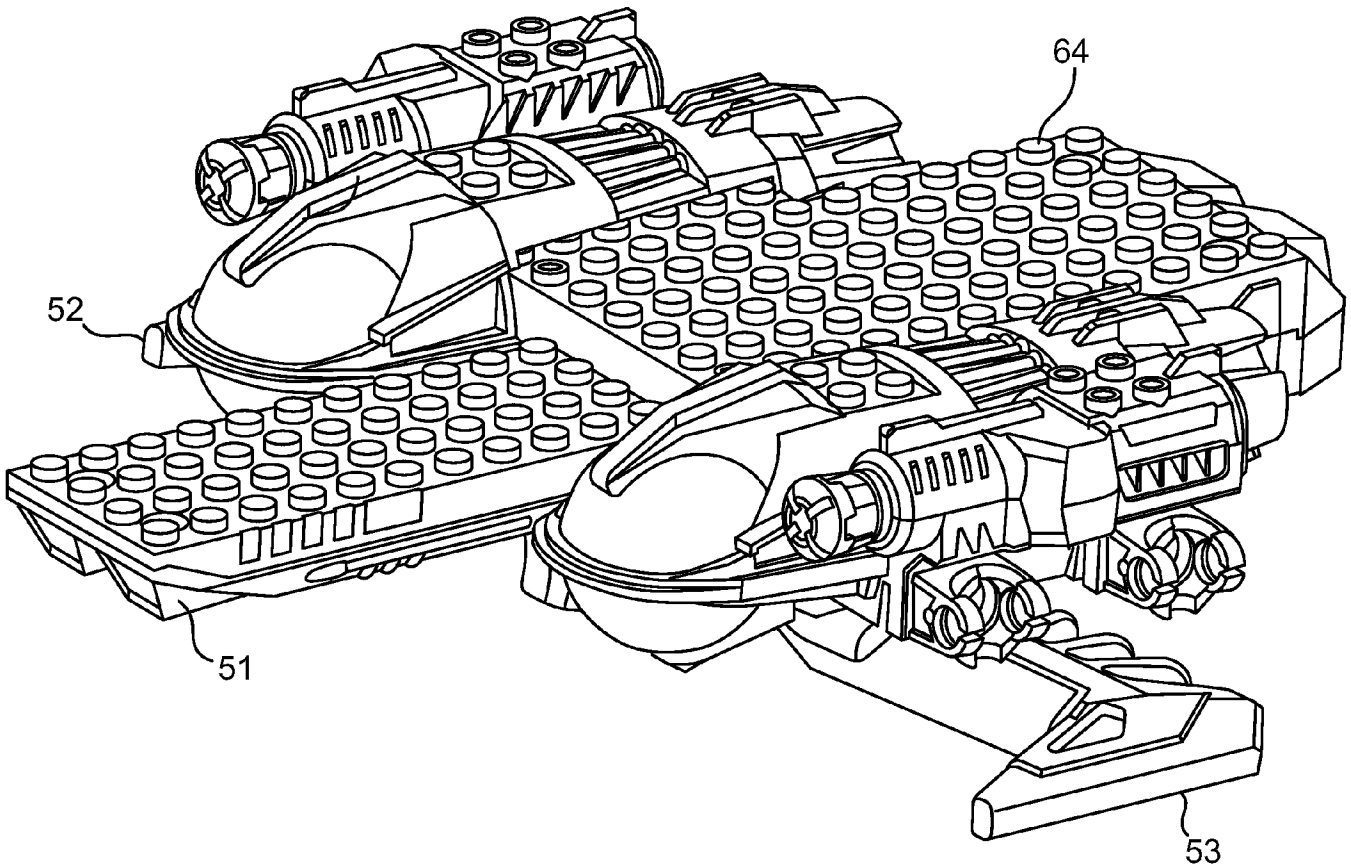
FIG. 14.4

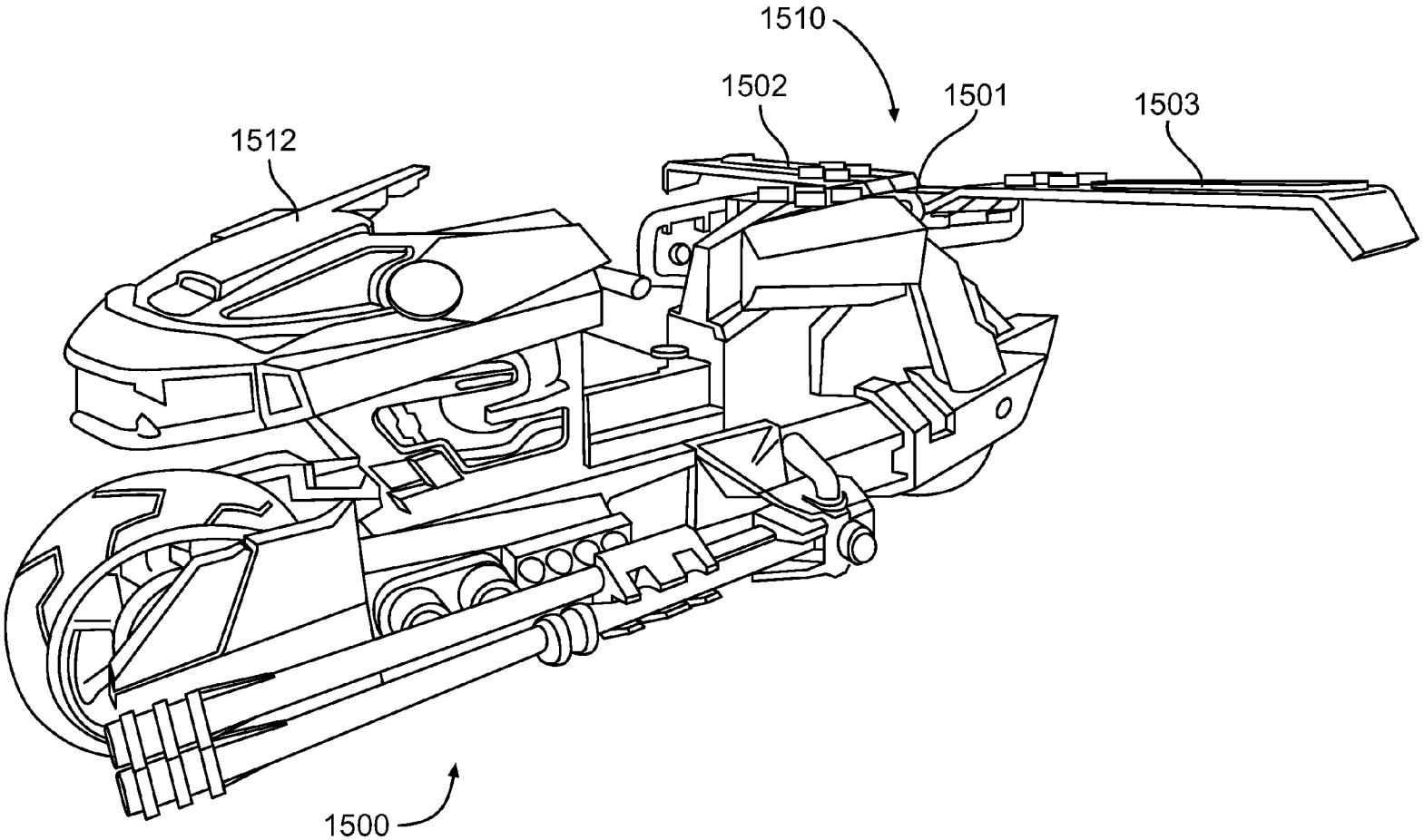
FIG. 15.1

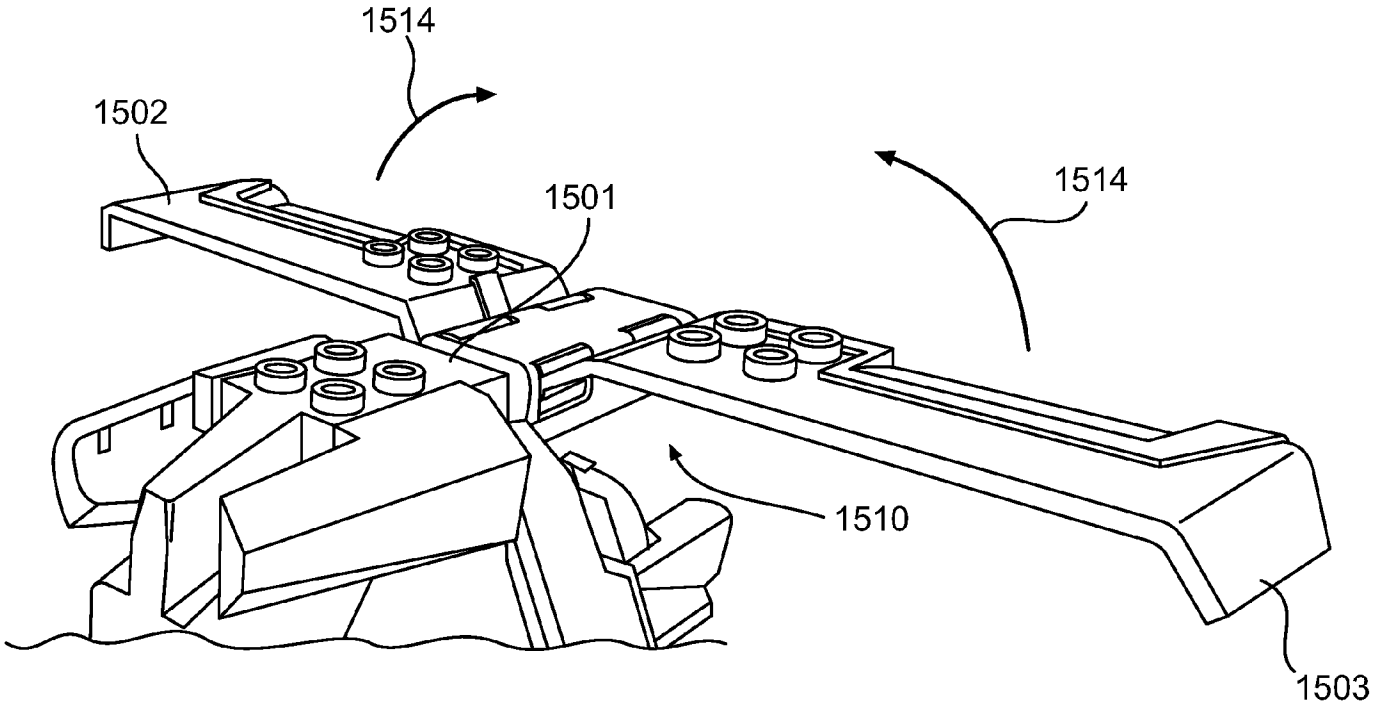
FIG. 15.2

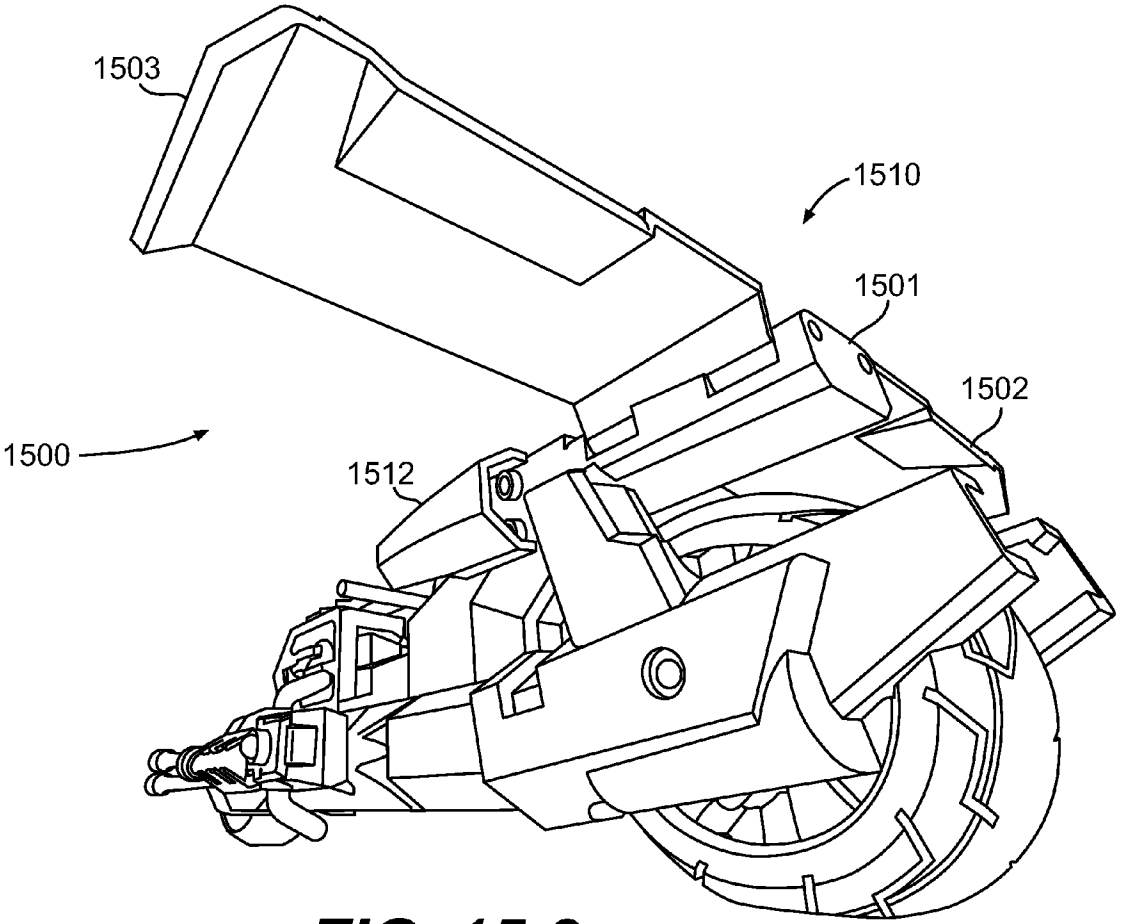
FIG. 15.3

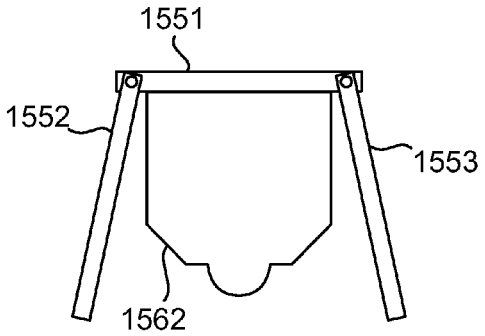
FIG. 15.4
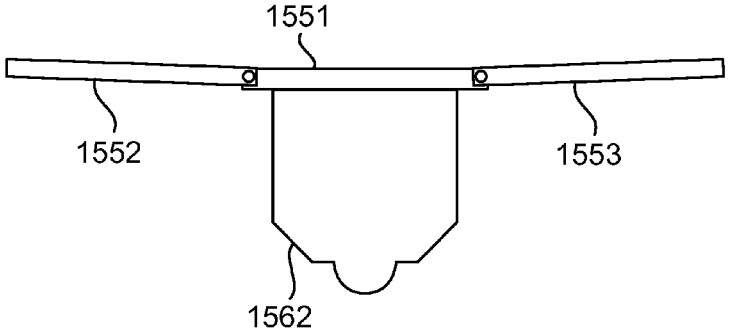
FIG. 15.5
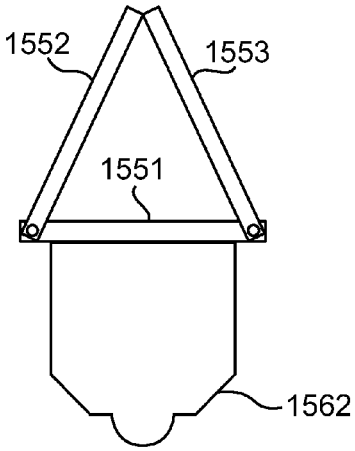
FIG. 15.6
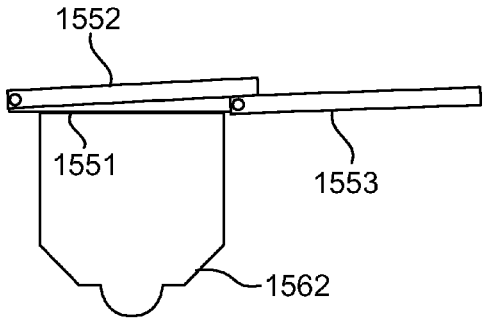
FIG. 15.7

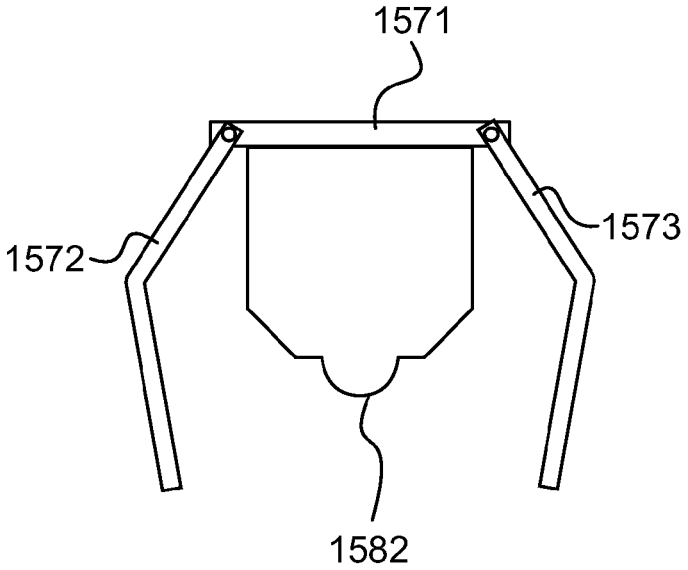
FIG. 15.8
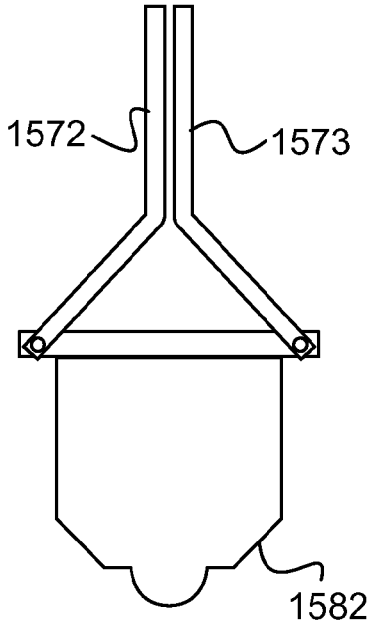
FIG. 15.9

TOY CONSTRUCTION BASE PLATE

This application claims the benefit of U.S. Provisional Patent Application No. 61/358,625, filed Jun. 25, 2010, which is herein incorporated by reference in its entirety.

BACKGROUND

1. Field of the Invention

The present invention relates generally to toy construction blocks, and more particularly, to a toy construction base plate configured to receive interlocking stackable blocks and having a collapsible handle.

2. Background of the Invention

Interlocking stackable toy construction blocks are well known in the field of toys and games. Although blocks may come in various sizes and shapes, a typical block is rectangular in shape and has upwardly projecting pegs on its top surface arranged in a matrix, and coupling means on its bottom surface for releasably interlocking the block to the top of another similar toy construction block having upwardly projecting pegs. Multiple blocks of varying shapes and sizes may be assembled into various toy constructions, such as houses, cars, airplanes, spaceships, and animals.

In building a toy construction, it is often helpful to use a base plate on which the interlocking blocks may be stacked. Typical base plates are square- or rectangular-shaped, wide, and flat, often having a height that is equal to one half or one third of the standard height of the interlocking blocks. The base plate may provide a level, sturdy structure on which to build block constructions. Such base plates may be especially suitable for toy constructions representing stationary structures, such as houses. However, conventional base plates may be less suitable for toy constructions representing moving objects (e.g., vehicles or animals), since attaching such constructions to a base plate may make the constructions immobile, or give them the appearance of being immobile.

Due to these limitations of conventional base plates, toy constructions representing moving objects tend to forgo the use of base plates. As a result, if a user wants to simulate movement of the construction, the user must handle the construction directly. In the case of a delicate construction, such as an airplane or spaceship, holding the construction by fragile parts, such as the tail or wings, may result in breaking the construction and frustrating the user. These drawbacks are especially troubling for children, who often have limited dexterity and may not handle the construction gently.

Accordingly, there is a need for base plates better suited for toy constructions representing moving objects.

SUMMARY

Embodiments provide a toy construction base plate configured to receive a toy construction and having a collapsible handle, which allows the construction to be built on the base plate on a flat play surface, after which the handle may be deployed from the base plate to allow a user to hold and play with the toy construction. The handle may be deployed by, for example, pivoting with respect to a support member of the base plate and pivoting above, below, or to the side of the toy construction. The handle may also be used as a stand to hold a construction above a play surface. The toy construction may be made of interlocking stackable blocks and the support surface of the base plate may be configured to receive the interlocking stackable blocks.

In one aspect, a base plate has a collapsible handle that may move between a first flat stowed position generally within or parallel to the plane of the base plate and a second deployed position at an angle to the plane of the base plate. In the first stowed position, the base plate may be placed on a flat play surface and interlocking blocks may be stacked on top of the base plate to build a toy construction. Then, the base plate and toy construction may be lifted off of the play surface, and the handle may be moved to the second deployed position. In the second deployed position, a user may grasp the handle and move the entire assembled toy construction that is connected to the base plate, to simulate movement of the construction. For example, the toy construction may represent a spaceship that the user moves with the base plate to simulate flight of the spaceship.

In another aspect, a collapsible handle may move incrementally from the first flat stowed position to the second deployed position at an angle to the plane of the base plate. For example, the second position may be generally perpendicular to the plane of the base plate and the handle may move in incremental angles between the first flat position generally parallel to the plane of the base plate to the second position generally perpendicular to the plane of the base plate. In one embodiment, the handle may stop at approximately a 45 degree angle. In other embodiments, the handle may stop at several points between the first and second positions. At each of these stops, a user may push the handle to "click" through the incremental stop and proceed toward either the first or second position. The incremental stops may hold the handle in a partially deployed position to serve as a stand for the construction, for example, holding the construction at different angles above a play surface at the different incremental stops. In some embodiments, the incremental movement may be provided by flexible, resilient arms at the hinge of the collapsible handle, which impede pivoting of the handle at the stop point. The resilient arms may temporarily deflect in response to a rotational force applied by a user to cause the handle to "click" through the stop point, moving in either direction, i.e., toward the stowed position or toward the deployed position. In some embodiments, stops may be provided at either or both of the stowed position and the deployed position. For example, a resilient arm may hold the handle in the stowed position, such that the user may push on the handle, deflect the resilient arm, and "click" through to the next incremental stop position or the final deployed position.

In embodiments, a collapsible handle may include only a single member that moves from a stowed position to a deployed position, for example, by pivoting with respect to a support member. In one example, a collapsible handle member comprising a single member may pivot toward the back of a support member. In other embodiments, a collapsible handle may comprise two or more members that each move between a first stowed position and a second deployed position and join each other at their second deployed positions to form a handle. In one embodiment, a collapsible handle may comprise a left handle member and an opposing right handle member, with each handle member pivoting from a first stowed position down to a second deployed position at which the two handle members come together to form a handle. In some embodiments, one or more of multiple handle members that come together at the second deployed position may include a spacer member that avoids portions of the members pressing against each other at a seam in which a hand of a user may get caught.

In some embodiments, a collapsible handle may include a spring that is biased to push a handle member away from the deployed position and to keep the handle member in the first incremental stop position nearest the deployed position, when no other forces are applied to the handle member. With the handle member biased in this manner, a user may hold the handle member to keep it in the deployed position. In the case of multiple biased handle members, a user may hold the members in their deployed positions as a handle to move a toy construction around, and when finished, may release the members over a play surface, at which point the biased handle members may automatically separate and move to their first incremental positions nearest their deployed positions. The separated biased handle members, held at their first incremental stop positions, may provide a stand on which the toy construction may be supported above the play surface.

In another aspect, a base plate may include provisions for activating electronic or mechanical features. In some embodiments, a base plate may include a trigger that is positioned near a handle when the handle is in a deployed position so that a user may grasp the handle and pull the trigger as desired. The trigger may activate mechanical features, such as launching projectiles, or electronic features, such as sounds or lights. In some embodiments, mechanical or electronic features may be activated by movement of the handle to one or more of the stowed, incremental, and deployed positions. For example, lights and sounds may be activated when the handle is held in the deployed position by a user.

In another aspect, a base plate may have a removable handle.

Another aspect provides a toy construction base plate comprising a support member, a first handle member, and a second handle member. The support member may extend substantially along a plane and may have a building surface on which to build a toy construction. The first handle member and second handle member may each be pivotably attached to the support member so as to pivot from a first position substantially parallel to the plane of the support member to a second position at an angle to the plane. In the second position, the first handle member and the second handle member may mate to form a handle. In the first position, the base plate may lie flat on a play surface. In the second position, the handle of the base plate may be configured to be held by a user to move the toy construction around.

In another aspect, the toy construction base plate may also include, for each of the first and second handle members, an incremental stop that stops the pivoting of the each first and second handle member between the first position and the second position to hold the first and second handle members in an incremental stop position. The hold of the incremental stop may be overcome by application of an external force. In the incremental stop position, the first handle member and the second handle member may be configured to rest on a play surface spread apart from each other to support a toy construction above the play surface.

In another aspect, the first handle member and the second handle member may be biased to automatically move from the second position to the incremental stop position, and to remain in the incremental stop position when no external force is applied.

In another aspect, a first spring member may push the first handle member from the second position to the incremental stop position and a second spring member may push the second handle member from the second position to the incremental stop position.

In another aspect, the building surface of the support member may be configured to receive interlocking stackable blocks.

In another aspect, the toy construction base plate may also include a spacer member that separates outer edges of the first handle member and the second handle member from each other when in the second position.

In another aspect, the toy construction base plate may also include a pad member pivotably attached to the support member so as to pivot from a first position substantially parallel to the plane of the support member to a second position at an angle to the plane, wherein distal ends of the first handle member, the second handle member, and the pad member are in a triangular configuration when in the second position.

In another aspect, each of the first and second handle members may be pivotable to a third position that is at an angle to the plane and on a side of the support member opposite to the second position, wherein in the third position, the first handle member and the second handle member are configured to support the toy construction above the play surface.

In another aspect, the first handle member and the second handle member may be configured to pivot between the second position and the third position approximately 270 degrees.

In another aspect, each of the first and second handle members may be bent such that a distal portion of the first handle member mates flat with a distal portion of the second handle member when the first and second handle members are in the second position.

Another aspect provides a toy construction base plate comprising a support member, a handle, and an incremental stop. The support member may extend substantially along a plane and may have a building surface on which to build a toy construction. The handle may be pivotably attached to the support member such that the handle pivots from a first stowed position at which the handle is substantially parallel to the plane of the support member to a deployed position at which the handle is at an angle to the plane. The incremental stop may stop the pivoting of the handle between the stowed position and the deployed position to hold the handle in an incremental stop position. The hold of the incremental stop may be overcome by application of an external force. In the stowed position, the base plate may lie flat on a play surface. In the deployed position, the handle of the base plate may be configured to be held by a user to move the toy construction around. In the incremental stop position, the handle may be configured to rest on the play surface and support the toy construction above the play surface.

In another aspect, the handle may be biased to automatically move from the deployed position to the incremental stop position, and to remain in the incremental stop position when no external force is applied.

In another aspect, the base plate may include a spring member that pushes the handle from the deployed position to the incremental stop position. The spring member may comprise a cantilever spring having a fixed end and a free distal end. The fixed end may be attached to the support member. The distal end may contact a surface of the handle. The distal end of the cantilever spring may be enclosed inside a spring chamber of the handle.

In another aspect, the incremental stop may comprise a resilient arm and a tab. The resilient arm may contact the tab to prevent pivoting of the handle. Upon application of an external force, the tab may deflect the resilient arm to permit pivoting of the handle.

In another aspect, the handle may comprise a first handle member and a second handle member, each pivotably attached to the support member. In the deployed position, the first handle member and the second handle member may mate to form the handle. The toy construction base plate may also include a spacer member that separates outer edges of the first handle member and the second handle member from each other when in the deployed position. In the incremental stop position, the first handle member and the second handle member may be spread apart to provide a foundation on which the toy construction may be held above a play surface.

In another aspect, the handle may comprise only one handle member.

In another aspect, the toy construction base plate may further comprise one of an electronic device and a mechanical device activated by one of pivoting movement of the handle and a trigger.

In another aspect, the handle may be removably attached to the support member.

Another aspect provides a toy construction base plate comprising a base support member and a plurality of handle members. The base support member may have a building surface on which to build a toy construction and a supported surface. The plurality of handle members may be secured to the supported surface of the base support member. The handle members may be movable between a first position in which the handle members are adapted to provide stable support for the toy construction base plate on a play surface and a second position in which the handle members are adapted to be held by a user to carry and move the toy construction base plate around.

In another aspect, the toy construction base plate may include a spring for biasing the handle members toward the first position.

In another aspect, the building surface of the support member may include a plurality of studs uniformly spaced apart in both longitudinal and transverse directions, so as to allow engagement with construction toy pieces.

In another aspect, the building surface of the support member may have a ferromagnetic portion for engaging magnetic construction toy pieces.

In another aspect, the building surface of the support member may have a plurality of openings for receiving complementary-shaped construction toy pieces.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 10.1 is a schematic diagram of an exploded isometric view of an embodiment of a base plate;

FIG. 10.2 is a schematic diagram of an isometric view of the base plate of FIG. 10.1 in an assembled condition;

FIG. 11.1 is a schematic diagram of an isometric view of the base plate of FIGS. 10.1 and 10.2 in a stowed position;

FIGS. 11.2-11.5 are schematic diagrams of front, side, top, and bottom views, respectively, of the base plate of FIGS. 10.1 and 10.2 in a stowed position;

FIG. 11.6 is a schematic diagram of a cross-sectional view of the base plate as shown in FIG. 11.4, taken along line 11.6-11.6;

FIG. 12.1 is a schematic diagram of an isometric view of the base plate of FIGS. 10.1 and 10.2 in an incremental stop position;

FIGS. 12.2-12.5 are schematic diagrams of front, side, top, and bottom views, respectively, of the base plate of FIGS. 10.1 and 10.2 in an incremental stop position;

FIG. 12.6 is a schematic diagram of a cross-sectional view of the base plate as shown in FIG. 12.4, taken along line 12.6-12.6;

FIG. 13.1 is a schematic diagram of an isometric view of the base plate of FIGS. 10.1 and 10.2 in a deployed position;

FIGS. 13.2-13.5 are schematic diagrams of front, side, top, and bottom views, respectively, of the base plate of FIGS. 10.1 and 10.2 in a deployed position;

FIG. 13.6 is a schematic diagram of a cross-sectional view of the base plate as shown in FIG. 13.4, taken along line 13.6-13.6;

FIG. 14.1 is a schematic diagram of a top isometric view of an exemplary base plate having provisions for activating electronic or mechanical features;

FIG. 14.2 is a schematic diagram of a bottom isometric view of the base plate of FIG. 14.1;

FIG. 14.3 is a schematic diagram of a top isometric view of the base plate of FIG. 14.1, with the upper surface of the support member shown;

FIG. 14.4 is a schematic diagram of a top isometric view of the base plate of FIG. 14.1, with an additional component enclosing the mechanical and electronic features of the base plate;

FIG. 15.1 is a schematic diagram of a top isometric view of an exemplary toy vehicle construction representing a motorcycle and having a base plate with handle members;

FIG. 15.2 is a schematic diagram of a close-up top isometric view of the base plate of FIG. 15.1;

FIG. 15.3 is a schematic diagram of a bottom isometric view of the toy vehicle construction of FIG. 15.1;

FIGS. 15.4-15.7 are schematic diagrams illustrating an embodiment of a base plate, showing representative positions of handle members with respect to a support member and a vehicle assembly;

FIGS. 15.8-15.9 are schematic diagrams illustrating another embodiment of a base plate, showing representative positions of alternative handles with respect to a support member and a vehicle assembly.

DETAILED DESCRIPTION

Embodiments of the present invention provide a base plate for a toy construction, which may provide a handle by which a user may hold, manipulate, or otherwise move the toy construction. The handle may also serve as a stand on which to support the toy construction above a play surface. The base plate may provide a solid connection between the handle of the base plate and an assembled toy construction. The handle may also represent a component of the toy construction, such as wings or landing gear of a toy airplane construction. The handle may comprise a single member, or alternatively, may comprise multiple members that together form a handle in their deployed positions.

Figure 1:
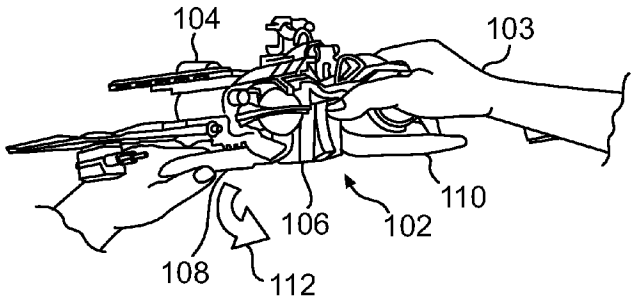
FIG. 1 is a schematic diagram that depicts an embodiment of a base plate and toy construction system, with the handle of the base plate in a stowed position.
Figure 2:
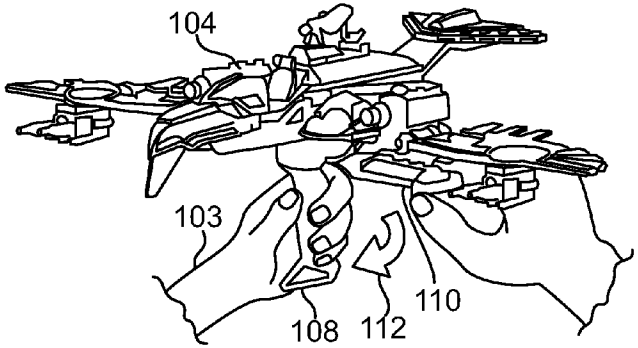
FIG. 2 is a schematic diagram that depicts the base plate and toy construction system of FIG. 1, with one handle member of the handle in a stowed position and another handle member of the handle in a deployed position.

FIGS. 1-9 illustrate an embodiment of a base plate and an associated toy construction, and a representative play pattern for the base plate and construction. As shown in FIG. 1, a base plate 102 may be connected to a toy construction 104, which in this example represents a flying animal or spaceship. The base plate 102 may include a support member 106 and a handle. The handle may comprise a single handle member. Alternatively, a handle may comprise a plurality of handle members that together form the handle. In the example of FIG. 1, the handle includes a first handle member 108 and a second handle member 110. The support member 106 may provide a surface on which to build the toy construction 104. The first handle member 108 and the second handle member 110 may be initially positioned generally within or parallel to the plane of the support member 106, as shown in FIG. 1. This initial stowed position allows the base plate 102 to lie flat on a play surface, to allow a user 103 to conveniently build the toy construction 104 on top of the base plate 102.

With the toy construction 104 built on top of base plate 102, as shown in FIG. 1, the user 103 may lift the toy construction 104 and connected base plate 102 off of a play surface. The user 103 may then pivot the first handle member 108 and the second handle member 110 down to a position at an angle to the support member 106, as represented by the arrows 112 in FIGS. 1 and 2. In embodiments, the first handle member 108 and the second handle member 110 pivot down to a deployed position generally perpendicular to the plane of the support member 106. In embodiments, handle members 108 and 110 may include provisions for holding them in the initial flat stowed position and for providing sensory feedback (e.g., a "click") to the user when the handle members are pivoted downward.

Figure 3:
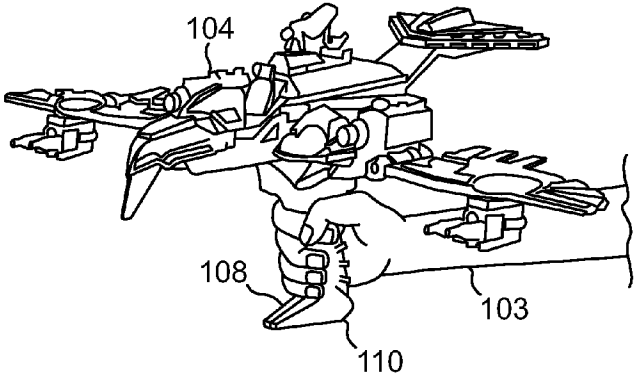
FIG. 3 is a schematic diagram that depicts the base plate and toy construction system of FIG. 1, with the handle in a deployed position.
Figure 4:
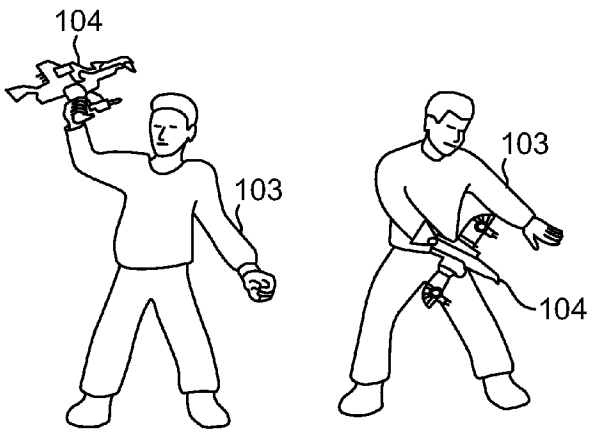
FIG. 4 is a schematic diagram that depicts a user moving the toy construction of FIG. 1 using the deployed handle of the base plate.

As shown in FIG. 3, the one or more handle members of a base plate may provide a handle for the user when in a deployed position. In embodiments, multiple handle members may be configured to pivot downward and join each other to form a handle. For example, as shown in FIG. 3, the first handle member 108 and the second handle member 110 may be configured as two opposing sections of a handle, which mate and form a handle that the user 103 may grasp. With this handle, which may be securely fastened to the toy construction, a user may conveniently move the toy construction 104 around, for example, to simulate flight of the construction. As an example, FIG. 4 depicts the user 103 moving the toy construction 104 using the deployed handle of the base plate.

After playing with the toy construction 104, the user may conveniently place the toy construction 104 and base plate 102 onto a play surface. In embodiments, the handle members 108 and 110 may be configured to support the toy construction 104 above the play surface. In some embodiments, the bottoms of the handle members 108 and 110 may be sized and shaped such that when the members are joined together in a deployed position, they provide a foundation sufficient to support the toy construction 104 on the play surface. In such cases, when the user releases the handle members, the handle members may stay together and provide the foundation. In other cases, however, the size and weight of the toy construction 104 may not allow for a reasonably sized and shaped bottom of the joined handle members. Accordingly, other embodiments may include provisions for separating the handle members to incremental positions between the deployed position and the stowed position, to provide multipoint support of the toy construction 104.

Figure 5:
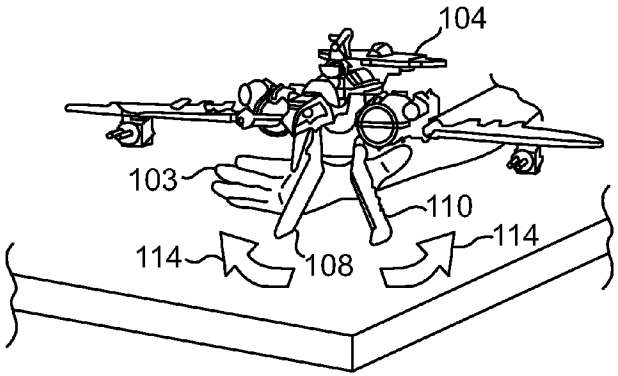
FIG. 5 is a schematic diagram that illustrates the base plate and toy construction system of FIG. 1, with the handle members of the handle spread apart.
Figure 6:
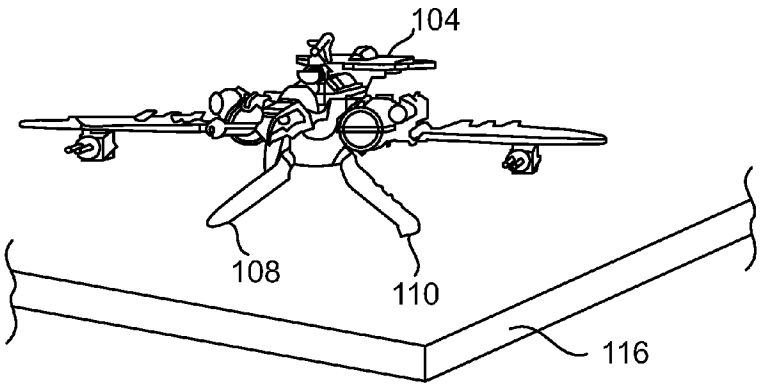
FIG. 6 is a schematic diagram that illustrates the base plate and toy construction system of FIG. 1 resting on a play surface, with the handle members of the handle spread apart at an incremental stop position.

As an example, FIG. 5 illustrates an embodiment in which the user 103 has released the handle and the first handle member 108 and the second handle member 110 spread apart, as represented by the arrows 114, to provide a multipoint support. In embodiments, the handle members 108 and 110 may be spread apart manually by the user 103. In other embodiments, the handle members 108 and 110 may include provisions for automatically spreading the handle members apart after the user 103 releases them. For example, the handle members 108 and 110 may have a spring that biases the members outwardly, pushing the members against a mechanical stop, such as a resilient arm. The spring and stop may keep the handle members positioned at a desired angle to provide a wide, level support for the toy construction. In one embodiment, the first handle member 108 and the second handle member 110 may separate to approximately 45 degrees and stay in that resting position, as shown in FIG. 6. The mechanical stop may prevent the handle members from going past the 45-degree position. The handle members may be forced past the mechanical stop, for example, by temporarily deflecting the mechanical stop out of the way, to pivot the handle members back to the flat, stowed position. In the example of FIG. 6, however, the toy construction is left to rest on a play surface 116, supported above that surface 116 by the first handle member 108 and the second handle member 110. In this resting position, the handle members 108 and 110 may be resting against mechanical stops to keep them in the depicted position.

Figure 7:
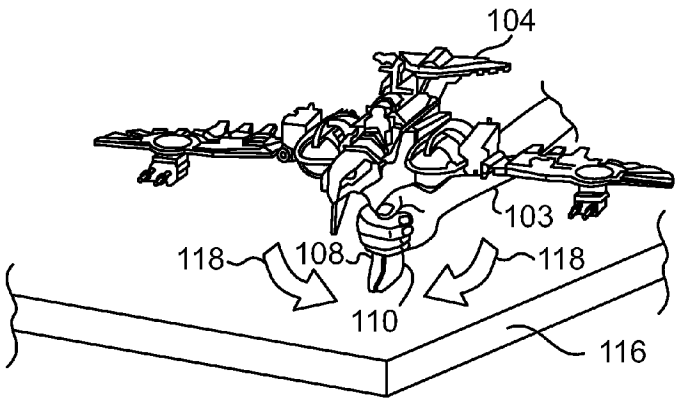
FIG. 7 is a schematic diagram that illustrates the base plate and toy construction system of FIG. 1 being lifted off of a play surface, with the handle members of the handle being moved together.
Figure 8:
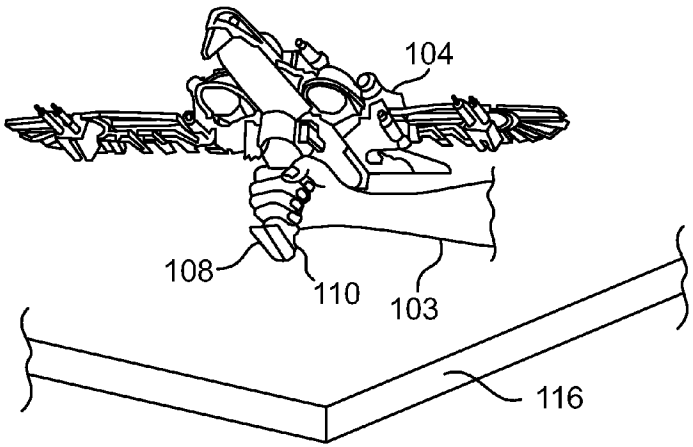
FIG. 8 is a schematic diagram that illustrates the base plate and toy construction system of FIG. 1 lifted off of a play surface and being moved around.
Figure 9:
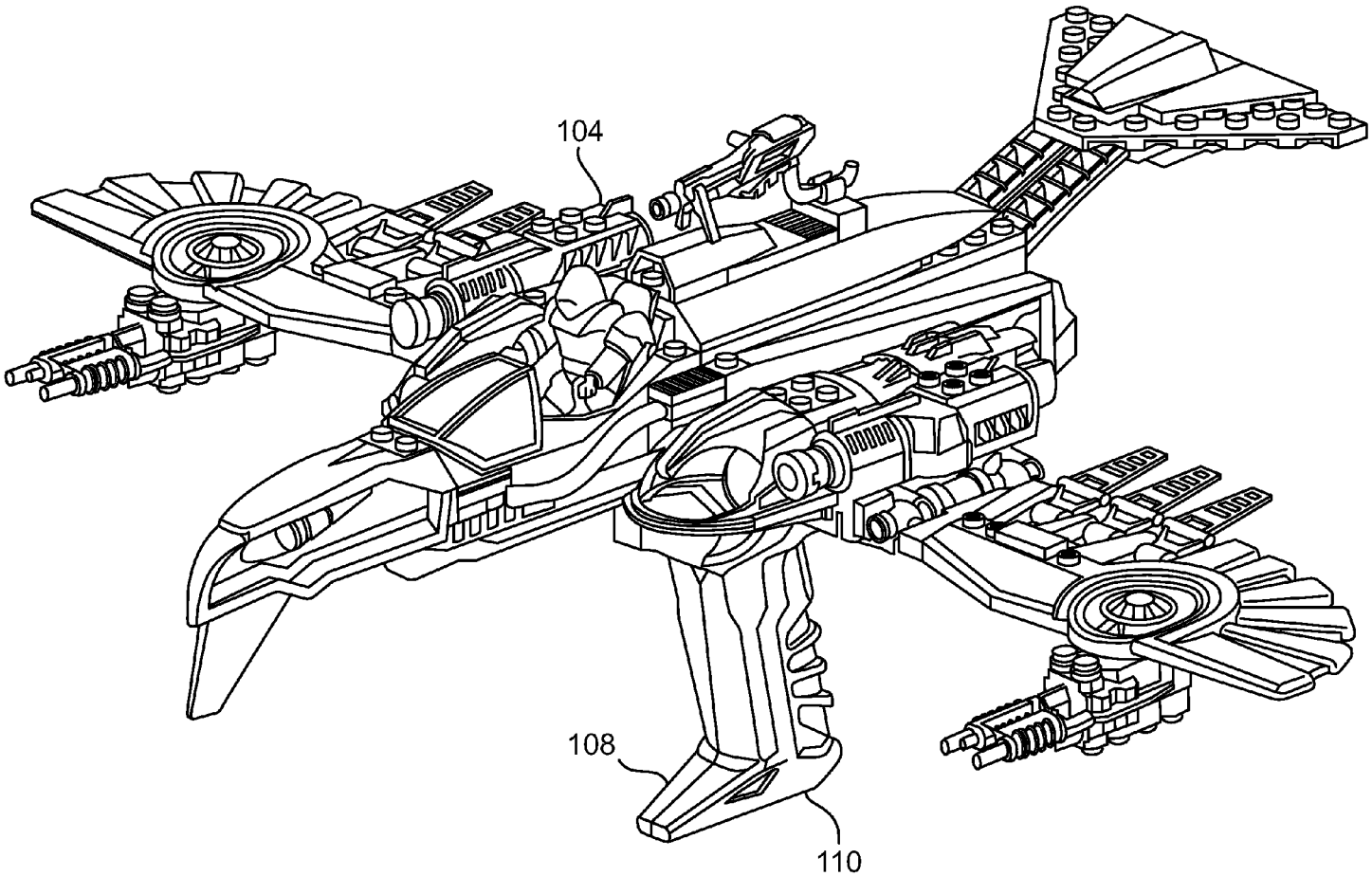
FIG. 9 is a schematic diagram that illustrates the base plate and toy construction system of FIG. 1 with the handle in the deployed position, omitting the hand of the user for clarity.

After leaving the toy construction 104 in the resting position, the user 103 may then decide to pick up the toy construction 104 and play with it again. In this case, as shown in FIGS. 6 and 7, the user 103 may grab the handle members 108 and 110, and squeeze them together, as represented by the arrows 118. The user 103 may then hold the handle formed by the members 108 and 110 and lift the toy construction 104 off of the play surface 116, as shown in FIGS. 7 and 8. For additional clarity, FIG. 9 shows the toy construction 104 and joined handle members 108 and 110 in the deployed position without the hand of the user, in the configuration in which the user may hold and play with the toy construction 104, for example, to simulate flight of the construction.

FIGS. 10.1-13.1 illustrate an exemplary base plate 10, according to one embodiment. As shown in the exploded view of FIG. 10.1, base plate 10 may include a support member 1, and a first handle member 2 and a second handle member 3 pivotably attached to the support member 1. Handle members 2 and 3 may be directly attached to the support member 1. Alternatively, as shown in FIG. 10.1, handle members 2 and 3 may be attached to support member 1 by a hinge member 4. Hinge member 4 may be attached to support member 1 by fasteners (e.g., screws) through openings 12 in hinge member and into openings (not shown in FIG. 10.1) in the underside of the support member 1. Handle members 2 and 3 may be pivotably attached to hinge member 4 by hinge posts 14 positioned within hinge openings 16 of hinge member 4. FIG. 10.2 illustrates an isometric view of the assembled base plate 10.

Base plate 10 may include provisions for building a toy construction on top of the base plate 10. These provisions may correspond to the type of toy construction system, including mechanical and magnetic systems. For example, in the case of a magnetic toy construction system, the base plate 10 may include a ferromagnetic material on an upper surface of the support member 1, to which magnetic construction elements of the system may be magnetically attached. Examples of suitable magnetic construction elements and systems are disclosed in U.S. Publication No. 2009/0015361, published Jan. 15, 2009, which is herein incorporated by reference in its entirety.

As another example, in the case of a mechanical system, the base plate 10 may include coupling means on an upper surface of the support member 1, which are compatible with the individual construction elements of the toy construction system. In one embodiment, as shown in FIG. 10.1, support member 1 may include projecting pegs 18 on its upper surface configured to couple with receiving openings on the underside of construction blocks. Exemplary construction blocks that may couple with the projecting pegs 18 are MEGA BLOKS MICROBLOKS produced by MEGA BRANDS of Montreal, Canada. In general, toy construction blocks are well known in the art and come in various sizes and shapes. The blocks are often rectangular in shape and have upwardly projecting pegs on their top surface arranged in a matrix, and means on their bottom surface for releasably interlocking one of these blocks on top of another toy construction block. Many other shapes are possible. Using a plurality of these blocks, one may assemble various structures, such as houses, cars, and airplanes. These blocks are extremely versatile given the variety of shapes available and their easy interlocking mechanism. Examples of toy construction blocks are disclosed in U.S. Pat. No. 5,827,106, issued Oct. 27, 1998, and U.S. Pat. No. 5,779,515, issued Jul. 14, 1998, both of which are herein incorporated by reference in their entirety.

In another embodiment, a support member may be provided with a plurality of openings for receiving complementary-shaped construction toy pieces. Examples of support members with openings receiving construction toy pieces are disclosed in U.S. Pat. No. 7,666,054, issued Feb. 23, 2010, which is herein incorporated by reference in its entirety.

Support member 1 may provide a sturdy, flat surface on which to build a toy construction. In one embodiment, a support member 1 may extend substantially along a plane and may have an upper surface that is substantially within one plane. In other embodiments, a support member may have a multi-level upper surface, which may be especially suited for a particular toy construction to be built on top of the support member. As one example, FIG. 10.1 shows support member 1 with two separate levels 24 and 26, each extending along a plane, with each of the planes being substantially parallel. In embodiments, a support member may extend along and define a plane, with one or more upper surfaces extending along the plane or parallel to the plane. In other embodiments, a support member may have one or more surfaces extending along a plane or parallel to the plane, with one or more other surfaces at an angle to the plane, for example, as appropriate for a toy construction being built off of the support member.

A support member may also have multiple surfaces that are angled with respect to each other. With this angled configuration, portions of a toy construction built off of the support member may be at an angle to each other.

A support member may also have a variety of different coupling means on its upper surface to accommodate different toy construction elements. For example, FIG. 10.1 shows support member 1 with different types of projecting pegs 18, including solid cylindrical pegs 28 and hollow cylindrical pegs 30.

As discussed above, a collapsible base plate may serve at least three different functions, including a structure on which to build a toy construction, a structure by which to hold and move a toy construction, and a structure by which to support, store, and display a toy construction on a play surface. In serving these functions, base plate 1 may include provisions for locking handle members 2 and 3 in a flat stowed position, in the deployed position, or at incremental positions between the stowed and deployed positions.

For example, in the embodiment of FIGS. 10.1-13.6, hinge member 4 may include resilient arms 20 that cooperate with tabs 22 on the handle members 2 and 3. As shown in FIGS. 11.1-11.6, especially the cross-sectional view of FIG. 11.6, starting from a stowed position with the handle members 2 and 3 generally parallel with the support member 1, pivotal movement downward of the handle members 2 and 3 may be impeded by the resilient arms 20 resting against the tabs 22. Forcing the handle members 2 and 3 downward toward the deployed position may cause the tabs 22 to push and deflect the resilient arms 20 outward beyond the rotational travel of the tabs 22, allowing the handle members 2 and 3 to pivot downward with respect to the support member 1. After the tabs 22 rotate past the resilient arms 20, the resilient arms 20 may move back to their original positions, as shown in FIG. 11.6. With the resilient arms 20 in their original positions, resilient arms 20 may also impede pivotal movement of the handle members 2 and 3 in the opposite direction from a deployed position to a stowed position. This impeded movement may hold the handle members 2 and 3 in a spread-apart configuration to serve the function of supporting a toy construction above a play surface. FIGS. 12.1-12.6 illustrate this position. As shown in FIG. 12.6, resilient arms 20 may impede tabs 22. Forcing the handle members 2 and 3 upward toward the stowed position may cause the tabs 22 to push and deflect the resilient arms 20 outward beyond the rotational travel of the tabs 22, allowing the handle members 2 and 3 to pivot upward with respect to the support member 1 and into the stowed position shown in FIGS. 11.1-11.6.

In the embodiment of FIGS. 10.1-13.6, in moving from the stowed position to the deployed position, after the tabs 22 clear the resilient arms 20, handle members 2 and 3 may pivot downward to a position generally perpendicular to the major plane of the support member 1 as shown in FIGS. 13.1-13.6. In this position, the handle members 2 and 3 may mate and form a handle that a user may grasp. In embodiments, handle members 2 and 3 may include provisions for avoiding tight fitting seams in which a user's hand may get caught. For example, as shown best in FIGS. 10.1 and 13.6, handle members 2 and 3 may include spacer members 32 that are positioned inside (e.g., centrally inside) the profiles of the handle members 2 and 3 and extend beyond the remaining outer portions of the members 2 and 3 so that the spacer members 32 contact each other first when in the deployed position. The spacer members 32 may be shaped (e.g., angled) so that they meet squarely together as shown in FIG. 13.6, for example. The spacer members 32 may provide a gap 34 between the remaining portions of the handle members 2 and 3, and avoid outer edges of the members 2 and 3 coming together in tight seams in which a user's hand may get caught. In addition, the spacer members 32 may be configured to extend a distance suitable for supporting the base plate 10 in a substantially level position when in the stowed position, as shown in FIG. 11.6, for example.

In some embodiments, a base plate may include provisions for automatically pivoting a handle from a deployed position at which a user holds the handle (e.g., as shown in FIGS. 13.1-13.6), to an incremental stop position at which the handle serves as a support for the toy construction on a play surface (e.g., as shown in FIGS. 12.1-12.6). Provisions for automatically pivoting a handle may include, for example, coiled springs, volute springs, leaf springs, cantilever springs, or elastic bands.

As an example, in the embodiment of FIGS. 10.1-13.6, base plate 10 may include flexible cantilever spring members 36 in the hinge member 4. Flexible cantilever spring members 36 may be made of flexible plastic or metal, for example. Flexible cantilever spring members 36 may be biased to generally assume the position shown in FIG. 10.1 or the position shown in FIG. 11.6. As shown in FIG. 11.6, when assembled with the support member 1 and the handle members 2 and 3 in a stowed position, the spring members 36 may be enclosed within spring chambers 38 of the handle members 2 and 3. In this position, the spring members 36 may be deflected slightly downward by walls of spring chambers 38 of the handle members 2 and 3. As the handle members 2 and 3 pivot downward, the walls of the chambers 38 may deform the flexible spring members 36 such that the spring members 36 straighten and then curve in a direction opposite to their original curved shapes. For example, as shown in the incremental stop position of FIG. 12.6, spring members 36 may be deformed to a substantially straight configuration as first walls 40 of the chambers 38 apply end forces to the distal ends of the spring members 36, while second walls 42 apply fulcrum forces to the spring members 36. As the handle members 2 and 3 continue to pivot toward the deployed position, walls of chambers 38 may continue to apply forces to the spring members 36 that further deform the spring members 36.

As shown in FIG. 13.6, in the deployed position, the walls of chambers 38 may press on the spring members 36 due to an external force (e.g., a user's hand) holding the handle members 2 and 3 together. In this position, energy may be stored in the deformed spring members 36, such that the spring members 36 may apply a force to the walls of the chambers 38 tending to move the handle members 2 and 3 outward and away from each other in a pivoting direction toward the stowed position. Thus, when the external force is removed, the spring members 36 may automatically push the handle members 2 and 3 apart, pivoting the members 2 and 3 to the first incremental stop position, as shown in FIG. 12.6. In that incremental stop position, the spring members 36 may help keep the handle members 2 and 3 forced outward, with the tabs 22 pressed against the resilient arms 20 and the members 2 and 3 in a fixed, stable position. This fixed position may help provide a sturdy structure on which to support a toy construction.

A further aspect of a base plate may include provisions for activating electronic or mechanical features. The features may be activated by movement of a collapsible handle. For example, as shown in FIGS. 14.1-14.4, in some embodiments, a base plate may include a trigger 50 that may be positioned near a handle (in this case, formed by handle members 52 and 53), when the handle is in a deployed position so that a user may grasp the handle and pull the trigger as desired. The trigger may activate mechanical features, such as launching projectiles, or electronic features, such as sounds or lights. For mechanical features, mechanical linkages may be provided in the support member 51 between the trigger 50 and the mechanism that drives the mechanical feature. For electronic features, a power source, circuitry, and light and audio output devices may be provided in the support member 51. As an example, the embodiment of FIGS. 14.1-14.4 show power source 60 and sockets 62 for receiving illumination devices (e.g., light emitting diodes), with other electrical features omitted for clarity. FIGS. 14.1 and 14.2 also omit the upper surface of support member 51 for clarity. FIG. 14.3 shows the upper surface of support member 51. FIG. 14.4 shows a more complete base plate with the electronic and mechanical features enclosed, and with the support member 51 ready to receive interlocking stackable blocks on its upper surface 64 for building of a toy construction.

In some embodiments, mechanical or electronic features may be activated by movement of the handle to one or more of the stowed, incremental, and deployed positions. For example, lights and sounds may be activated when the handle members 52 and 53 are held in the deployed position by a user.

In some embodiments, a base plate or toy construction may include provisions for providing additional support of the toy construction when placed on a play surface and when held by a user. For example, referring to FIG. 9, a pad may extend vertically downward from a rear portion (e.g., the tail) of the toy construction. The pad may be attached to the base plate or to the toy construction. The pad may support the toy construction in conjunction with the handle members 108 and 110 when placed on a play surface with the handle members 108 and 110 spread apart, e.g., in a triangular or tripod configuration. The pad may also support the toy construction in conjunction with the handle members 108 and 110 when held by a user, with the handle members 108 and 110 joined together as a handle, with the user holding the handle, and with the pad placed on the shoulder of the user similar to the manner by which large video cameras are held. This configuration may be especially useful for holding, balancing, and moving large toy constructions. The pad may also be pivotable and collapsible, similar to the handle members 108 and 110, to allow the pad to lie flat during assembly of the toy construction.

Figure 16:
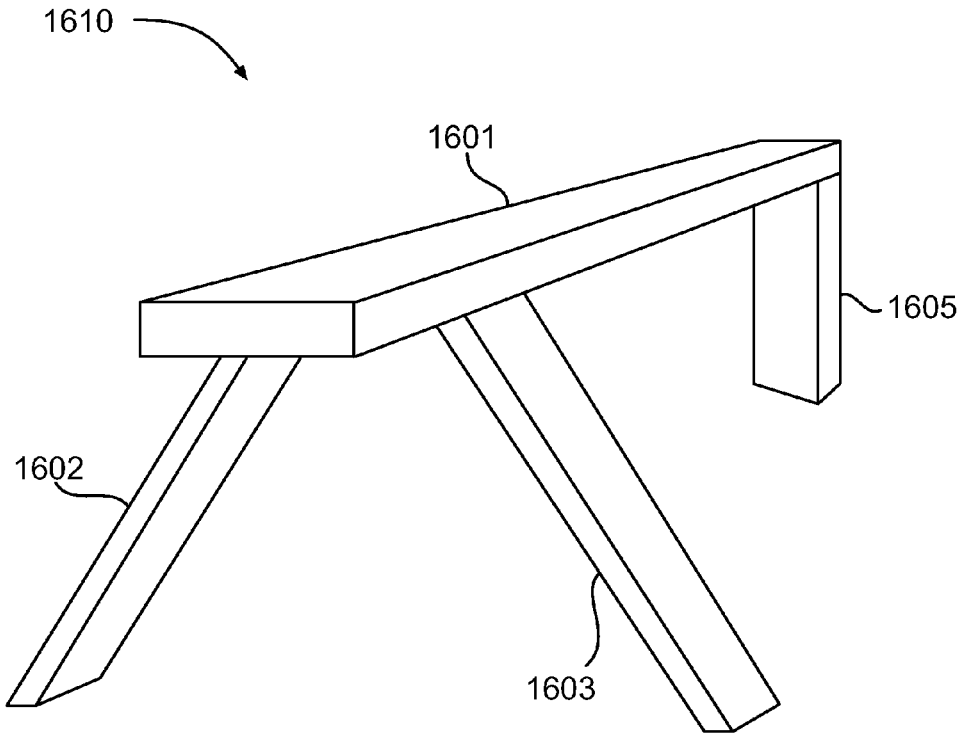
FIG. 16 is a schematic diagram of an isometric view of an exemplary base plate having a support member, a first handle and second handle member, and a pad member.

As an example, FIG. 16 schematically depicts a base plate 1610 in a deployed position having a support member 1601, a first handle member 1602, a second handle member 1603, and a pad member 1605. Each of the handle members 1602 and 1603 and pad member 1605 may pivot with respect to the support member 1601 from a first position at which it is substantially parallel to the major plane of the support member 1601 to a second position at which it is at an angle to the major plane of the support member 1601. FIG. 16 shows the members 1602, 1603, and 1605 in the second position. The triangular orientation of the members 1602, 1603, and 1605 in the deployed second position may provide beneficial stability for supporting a toy construction attached to the support member 1601 over a play surface.

In embodiments, a collapsible handle may be formed as a single handle member that moves with respect to a support member from a stowed position to a deployed position. The single handle member may be attached to the support member at a position that assists the user in conveniently balancing and holding a toy construction built on the support member. For example, the single handle member, when in the deployed position, may be located under the center of gravity of the combined support member and toy construction. With reference to FIG. 16, for example, a collapsible handle may be provided by member 1605 alone, excluding members 1602 and 1603. In FIG. 16, if the end of the support member 1601 to which member 1605 is attached is taken to be the back end of the support member 1601, then the member 1605 may pivot backward away from the front end of the support member 1601 to be moved to the stowed position. In other embodiments, the member 1605 (with the members 1602 and 1603 excluded) may be attached to support member 1601 at a position more forward of the position shown in FIG. 16, for example, at the center of the support member 1601 if the center of gravity of the support member 1601 and a toy construction built on the support member 1601 is at that center location. In such case, the member 1605 may be held when in a deployed position generally perpendicular to the support member 1601, and when ready to be stowed, may be pivoted forward or backward to a stowed position generally parallel to the support member 1601. To accommodate the stowed position, in embodiments, a support member may include one or more recesses in its underside into which one or more handle members may be stowed to, for example, enable the support member and stowed handle member(s) to lie essentially flat on a horizontal play surface. FIG. 11.1 illustrates an example of such recesses in a support member 1, which enable support member 1 and handle members 2 and 3 to lie essentially flat.

A further aspect of a base plate may include provisions for a removable handle. This feature may allow a user to build a toy construction on the base plate, play with the construction using the handle as described above, and then remove the handle to store or display the construction. A removable handle may be useful for toy constructions on which a stowed handle may appear out of place or otherwise detract from the aesthetic appeal of the construction. For instance, referring to FIG. 10.1, handle members 2 and 3 may be removably attached to hinge member 4, for example, by snapping the hinge posts 14 of handle members 2 and 3 into and out of the hinge openings 16 of the hinge member 4. Other removably attached connections may be possible. For example, each of handle member 2 and 3 may be formed in two parts, including a first short hinge part that remains pivotably attached to the hinge member 4 and a second longer grip part that detachably connects to the first hinge part. The hinge part and grip part may, for example, connect to each other by releasable male-female snap fittings, such as those used on plastic snap lock buckles.

Although aspects disclosed herein illustrate handles extending generally below and perpendicular to a toy construction, other aspects may position a handle differently with respect to a toy construction. These alternative handle configurations may accommodate a particular toy construction and how that particular construction is best handled, balanced, and played with by a user. In one aspect, rather than having a handle extend generally perpendicularly from a support member, a handle may extend at an angle to the support member. In another aspect, rather than having a handle extend below a support member, a handle may extend above and/or to the side of a support member, with the toy construction built below and/or to the side of the support member. This configuration may be especially useful for toy constructions representing vehicles that travel on a surface, such as on a road or on water. A user may hold the toy construction from the side or from above, and may move the toy construction across the play surface, for example, pretending to move the toy construction on a road or on water. A handle extending below the toy construction might impede such play.

As an example of alternative handle positioning, FIGS. 15.1-15.3 illustrate a toy vehicle construction 1500 representing a motorcycle. As shown, construction 1500 may include a base plate 1510 and a vehicle assembly 1512 attached to the base plate 1510. The base plate 1510 may include a support member 1501 and a first handle member 1502 and second handle member 1503 attached to the support member 1501. Handle members 1502 and 1503 may be pivotably attached to support member 1501 and may rotate upward as represented by the arrows 1514 (in FIG. 15.2) to join each other and form a handle, similar to the other embodiments described above. A user may hold and manipulate the vehicle assembly 1512 with the handle members down and apart, up and joined together, or in any position in between those limits. Base plate 1510 may also provide incremental stop positions for handle members 1502 and 1503, through which a user may "click" through by applying an external force.

In a further aspect, handle members of a base plate may pivot with respect to a support member more than 90 degrees to provide further options for holding, handling, supporting, and displaying a toy construction. For example, referring to FIGS. 15.1-15.3, each of handle members 1502 and 1503 may rotate approximately 270 degrees or more, from a position nearly vertical with respect to the motorcycle assembly 1512 to a position nearly horizontal across the top of the support member 1501 and motorcycle assembly 1512. This range of rotation may enable the handle members 1502 and 1503 to function both as a stand when they are in approximately a vertical down position, and also as a handle when they are in a higher horizontal or vertical position, either separated or joined together. As a further illustration, FIGS. 15.4-15.7 schematically depict representative positions of handle members 1552 and 1553, with respect to a support member 1551 and a vehicle assembly 1562. FIG. 15.4 illustrates handle members 1552 and 1553 positioned generally downward to support the vehicle assembly 1562 above a play surface. FIG. 15.5 illustrates handle members 1552 and 1553 positioned generally horizontal to provide separate handles to hold and manipulate vehicle assembly 1562. FIG. 15.6 illustrates handle members 1552 and 1553 positioned generally upward and joined together, to form a handle by which to hold and manipulate vehicle assembly 1562. FIG. 15.7 illustrates handle member 1552 pivoted approximately 270 degrees from the position shown in FIG. 15.4 to overlap and join the handle member 1553 to provide a structure by which to hold and manipulate the vehicle assembly 1562. In each of these different positions of FIGS. 15.4-15.7, a base plate may include provisions for holding the handle members in the desired position, for example, using resilient mechanical stops that can be overcome (e.g., "clicked" through) by application of moderate external force.

Embodiments may also include provisions for accommodating wide support members while still allowing handle members to meet to form a handle. For example, the handle members may be nonlinear so that when they are pivoted and mated together, portions of opposing handle members mate up against each other. As an example, FIGS. 15.8 and 15.9 illustrate bent handle members 1572 and 1573 pivotably attached to a wide support member 1571 at opposite ends of the support member 1571. The handle members 1572 and 1573 may pivot from a first position at which they support a vehicle assembly 1582 above a play surface as shown in FIG. 15.8, to a second position at which they mate with each other and form a handle that a user may grasp as shown in FIG. 15.9. As shown, the distal portions of the handle members 1572 and 1573 beyond their bends mate flat with each other to form the handle.

The foregoing disclosure of the preferred embodiments has been presented for purposes of illustration and description. It is not intended to be exhaustive or to limit the invention to the precise forms disclosed. Many variations and modifications of the embodiments described herein will be apparent to one of ordinary skill in the art in light of the above disclosure.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present invention.

What is claimed is:

1. A toy construction base plate comprising:

a support member extending substantially along a plane and having a building surface on which to build a toy construction; and a first handle member and a second handle member, wherein each of the first handle member and the second handle member extends in a substantially straight direction from a pivot end to a distal end, wherein each of the first handle member and the second handle member has the pivot end pivotably attached to the support member so as to pivot from a first position substantially parallel to the plane of the support member to a second position at an angle to the plane, wherein in the second position, the first handle member and the second handle member mate to form a handle, wherein in the first position, the support member, the first handle member, and the second handle member lie flat on a flat play surface, the substantially straight direction of the first handle member from the pivot end to the distal end of the first handle member is generally parallel to the flat play surface, and the substantially straight direction of the second handle member from the pivot end to the distal end of the second handle member is generally parallel to the flat surface, and wherein in the second position, the handle of the base plate is graspable by a user to move the toy construction around.

2. The toy construction base plate of claim 1, further comprising for each of the first and second handle members an incremental stop that stops the pivoting of the each first and second handle member between the first position and the second position to hold the first and second handle members in an incremental stop position, wherein the incremental stop comprises a resilient arm and a tab, wherein the resilient arm contacts the tab in the first position to resist pivoting of the respective handle member, wherein application of a first external force to the respective handle member in a direction from the first position to the second position causes the tab to deflect the resilient arm and allow the pivoting of the respective handle member between the second position and the incremental stop position, wherein, when the respective handle member is pivotable between the second position and the incremental stop position, contact between the resilient arm and the tab stops the pivoting of the respective handle member at the incremental stop position, wherein the hold of the incremental stop is overcome by application of a second external force to the respective handle member in a direction from the second position to the first position that causes the tab to deflect the resilient arm and allow the respective handle member to pivot back to the first position, and wherein in the incremental stop position, the first handle member and the second handle member rest on a play surface spread apart from each other to support a toy construction above the play surface.

3. The toy construction base plate of claim 2, wherein the first handle member and the second handle member are biased to automatically move from the second position to the incremental stop position, and to remain in the incremental stop position when no external force is applied.

4. The toy construction base plate of claim 3, wherein a first spring member has a first attachment end attached to the support member and a first pushing end opposite to the first attachment end, wherein the first pushing end pushes the first handle member at a point between the pivot end of the first handle member and the distal end of the first handle member to pivot the first handle member from the second position to the incremental stop position, and wherein a second spring member has a second attachment end attached to the support member and a second pushing end opposite to the second attachment end, wherein the second pushing end pushes the second handle member at a point between the pivot end of the second handle member and the distal end of the second handle member to pivot the second handle member from the second position to the incremental stop position.

5. The toy construction base plate of claim 2, wherein the resilient arm comprises a substantially vertical portion that extends vertically from the support member and a substantially horizontal portion that extends from the vertical portion to define a corner area within the resilient arm, and wherein the tab is formed on the pivot end of the respective handle member and slides within the corner area of the resilient arm.

6. The toy construction base plate of claim 1, wherein the building surface of the support member has projecting pegs that receive corresponding openings in interlocking stackable blocks.

7. The toy construction base plate of claim 1, further comprising:

a first spacer member on the first handle member positioned inside a profile of the first handle member when the first handle member is viewed along a travel path direction of the first handle member from the first position to the second position; and a second spacer member on the second handle member positioned inside a profile of the second handle member when the second handle member is viewed along a travel path direction of the second handle member from the first position to the second position, wherein the first spacer member extends beyond a profile of the first handle member and toward the second handle member when in the second position and viewed perpendicularly to the travel path direction of the first handle member, wherein the second spacer member extends beyond a profile of the second handle member and toward the first handle member when in the second position and viewed perpendicularly to the travel path direction of the second handle member, such that the first spacer member and the second spacer member contact each other in the second position and separate outer edges of the first handle member and the second handle member from each other when in the second position.

8. The toy construction base plate of claim 7, wherein each of the first spacer member and the second spacer member has an angled contacting surface such that the angled contacting surfaces of the first spacer member and the second spacer member mate flat with each other in the second position and such that the angled contacting surfaces of the first spacer member and the second spacer member each lie flat on the play surface in the first position and hold the respective first and second handle members at angles such that the respective substantially straight directions of the respective first and second handle members are generally parallel to the flat play surface.

9. The toy construction base plate of claim 1, further comprising a pad member pivotably attached to the support member so as to pivot from a first position substantially parallel to the plane of the support member to a second position at an angle to the plane, wherein distal ends of the first handle member, the second handle member, and the pad member are in a triangular configuration when in the second position.

10. The toy construction base plate of claim 1, wherein each of the first and second handle members is pivotable to a third position that is at an angle to the plane and on a side of the support member opposite to the second position, and wherein in the third position, the first handle member and the second handle member support the toy construction above the play surface.

11. The toy construction base plate of claim 10, wherein the first handle member and the second handle member pivot between the second position and the third position approximately 270 degrees.

12. A toy construction base plate comprising:

a support member extending substantially along a plane and having a building surface on which to build a toy construction;

a handle pivotably attached to the support member, wherein the handle has a pivot end and a distal end opposite to the pivot end, wherein the handle pivots from a first stowed position at which the handle is substantially parallel to the plane of the support member to a deployed position at which the handle is at an angle to the plane; and an incremental stop that stops the pivoting of the handle between the stowed position and the deployed position to hold the handle in an incremental stop position, wherein the hold of the incremental stop may be overcome by application of an external force, wherein in the stowed position, the support member and the handle lie flat on a flat play surface, wherein in the stowed position, the handle extends from the pivot end to the distal end in a straight direction that is generally parallel to the flat play surface, wherein in the deployed position, the handle of the base plate is graspable by a user to move the toy construction around, and wherein in the incremental stop position, the handle rests on the play surface and supports the toy construction above the play surface.

13. The toy construction base plate of claim 12, wherein the handle is biased to automatically move from the deployed position to the incremental stop position, and to remain in the incremental stop position when no external force is applied.

14. The toy construction base plate of claim 13, wherein the base plate comprises a spring member that pushes the handle from the deployed position to the incremental stop position.

15. The toy construction base plate of claim 14, wherein the spring member comprises a cantilever spring having a fixed end and a free distal end, wherein the fixed end is attached to the support member, and wherein the distal end contacts a surface of the handle.

16. The toy construction base plate of claim 15, wherein the distal end of the cantilever spring is enclosed inside a spring chamber of the handle.

17. The toy construction base plate of claim 12, wherein the incremental stop comprises a resilient arm and a tab, wherein the resilient arm comprises an upper arm portion and a forearm portion at an angle to the upper arm portion, wherein the upper arm portion and the forearm portion define an interior corner area, wherein the tab is formed on the pivot end of the handle and slides within the corner area of the resilient arm, wherein the resilient arm contacts the tab in the stowed position to resist pivoting of the handle, wherein application of a first external force to the handle in a direction from the first position to the second position causes the tab to deflect the resilient arm and allow the pivoting of the handle between the deployed position and the incremental stop position, wherein, when the handle is between the deployed position and the incremental stop position, contact between the resilient arm and the tab stops the pivoting of the handle at the incremental stop position, and wherein the hold of the incremental stop is overcome by application of a second external force to the handle in a direction from the deployed position to the stowed position that causes the tab to deflect the resilient arm and allow the handle to pivot back to the first position.

18. The toy construction base plate of claim 12, wherein the handle comprises a first handle member and a second handle member, each pivotably attached to the support member, and wherein in the deployed position, the first handle member and the second handle member mate to form the handle.

19. The toy construction base plate of claim 18, further comprising:

a first spacer member on the first handle member positioned inside a profile of the first handle member when the first handle member is viewed along a travel path direction of the first handle member from the stowed position to the deployed position; and a second spacer member on the second handle member positioned inside a profile of the second handle member when the second handle member is viewed along a travel path direction of the second handle member from the stowed position to the deployed position, wherein the first spacer member extends beyond a profile of the first handle member and toward the second handle member when in the deployed position and viewed perpendicularly to the travel path direction of the first handle member, wherein the second spacer member extends beyond a profile of the second handle member and toward the first handle member when in the deployed position and viewed perpendicularly to the travel path direction of the second handle member, such that the first spacer member and the second spacer member contact each other in the deployed position and separate outer edges of the first handle member and the second handle member from each other when in the deployed position.

20. The toy construction base plate of claim 18, wherein in the incremental stop position, the first handle member and the second handle member are spread apart to provide a foundation on which the toy construction is held above the play surface.

21. The toy construction base plate of claim 12, wherein the handle comprises only one handle member.

22. The toy construction base plate of claim 12, further comprising one of an electronic device and a mechanical device activated by one of pivoting movement of the handle and a trigger.

23. The toy construction base plate of claim 12, wherein the handle is removably attached to the support member.

24. A toy construction base plate comprising:

a base support member having a building surface on which to build a toy construction and a supported surface; and a plurality of handle members secured to the supported surface of the base support member, the handle members being movable between a first position in which the handle members provide stable support for the toy construction base plate on a flat play surface, a second position in which the handle members are mated together and held by a user to carry and move the toy construction base plate around, and a third position in which the base support member and each of the plurality of handle members lie flat on the flat play surface, wherein each handle member of the plurality of handle members extends in a substantially straight direction from a pivot end attached to the supported surface of the base support member to a distal end, wherein, in the third position, the substantially straight direction of the each handle member from the pivot end to the distal end is generally parallel to the flat play surface, wherein, when each of the plurality of handle members is between the first position and the second position with no external forces applied, each of the plurality of handle members is biased to remain in the first position with its distal end on the flat play surface to provide the stable support for the toy construction base plate on the flat play surface.

25. The toy construction base plate of claim 24, further comprising a spring that biases the handle members in a direction from the second position toward the first position such that the handle members remain in the first position if no external force is applied.

26. The toy construction base plate of claim 24, wherein the building surface of the support member includes a plurality of studs uniformly spaced apart in both longitudinal and transverse directions, so as to allow engagement with construction toy pieces.

27. The toy construction base plate of claim 24, wherein the building surface of the support member is provided with a ferromagnetic portion for engaging magnetic construction toy pieces.

28. The toy construction base plate of claim 24, wherein the building surface of the support member is provided with a plurality of openings for receiving complementary-shaped construction toy pieces.

* * * * *